US005642681A

United States Patent [19]

Adamski, Jr. et al.

[11] Patent Number: 5,642,681

[45] Date of Patent: Jul. 1, 1997

[54] SEWING SLEEVES ON SHIRT BODIES

[75] Inventors: Maximilian Adamski, Jr.; Steve J. Pagett, both of Tega Cay, S.C.

[73] Assignee: Union Special Corp., Huntley, Ill.

[21] Appl. No.: 525,490

[22] Filed: Sep. 8, 1995

Related U.S. Application Data

[63] Continuation of Ser. No. 311,330, Sep. 23, 1994.

[51] Int. Cl.[6] ..... D05B 25/00; D05B 27/10; D05B 35/10

[52] U.S. Cl. ..... 112/475.09; 112/155; 112/322; 112/470.07; 112/470.29

[58] Field of Search ..... 112/475.09, 475.04, 112/475.07, 475.03, 470.07, 470.29, 470.31, 63, 306, 2, 104, 155, 322, 470.05

[56] References Cited

U.S. PATENT DOCUMENTS

| | | | |
|---|---|---|---|
| 4,159,687 | 7/1979 | Masuda et al. . | |
| 4,467,734 | 8/1984 | Rohr . | |
| 4,467,739 | 8/1984 | Hager et al. . | |
| 4,479,447 | 10/1984 | Rohr . | |
| 4,512,268 | 4/1985 | Rohr . | |
| 4,681,051 | 7/1987 | Kirch et al. . | |
| 4,682,553 | 7/1987 | Bachmann et al. . | |
| 4,744,319 | 5/1988 | Rohr . | |
| 4,823,716 | 4/1989 | Nakashima . | |
| 4,827,856 | 5/1989 | Rohr . | |
| 4,827,858 | 5/1989 | Horie et al. . | |
| 4,836,119 | 6/1989 | Siraco et al. . | |
| 4,998,493 | 3/1991 | Tanaka . | |
| 5,029,541 | 7/1991 | Rohr et al. . | |
| 5,103,749 | 4/1992 | Geisselmann et al. . | |
| 5,188,047 | 2/1993 | Rohr et al. . | |
| 5,251,557 | 10/1993 | Rohr . | |
| 5,406,900 | 4/1995 | Schramayr et al. | 112/475.04 X |
| 5,419,268 | 5/1995 | Fylen et al. | 112/475.07 X |
| 5,505,149 | 4/1996 | Schramayr et al. | 112/470.29 |
| 5,540,166 | 7/1996 | Wiley | 112/470.07 X |

FOREIGN PATENT DOCUMENTS

| | | |
|---|---|---|
| 62-94195 | 4/1987 | Japan . |

*Primary Examiner*—Peter Nerbun

*Attorney, Agent, or Firm*—Brinks Hofer Gilson & Lione

[57] ABSTRACT

A work station for an operator using two sewing machines that have automatic sew cycles and work piece control and advancing mechanisms for setting sleeves in shirt bodies. Sleeves and shirt bodies are presented to the operator at the work station in a manner that they can be easily and quickly grasped which enables the operator to load the work piece components on one machine while the automatic sew cycle of the other machine being performed. The sewn products in both the intermediate and final stage are automatically removed from the sewing machines and discharged to a completed product tray.

12 Claims, 16 Drawing Sheets

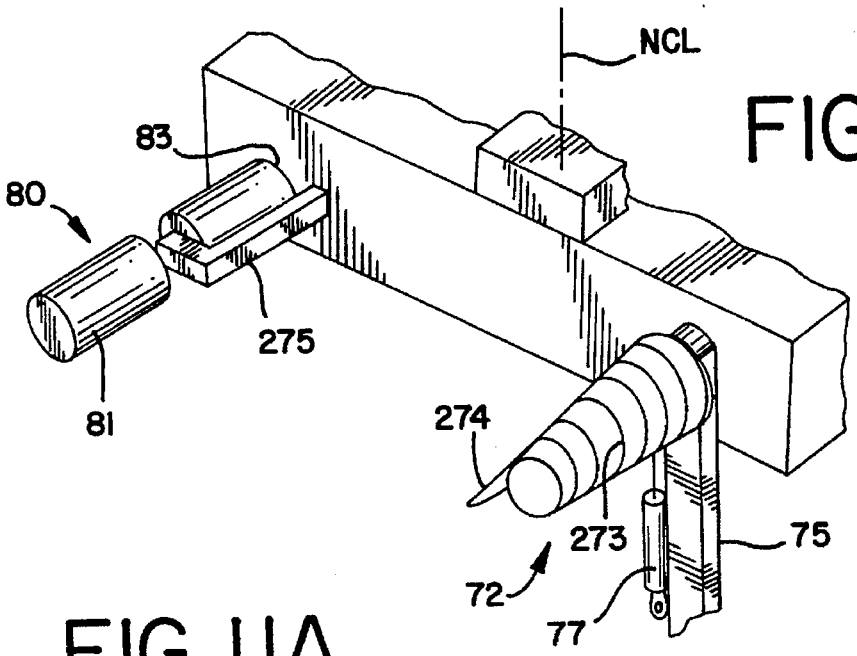
FIG. 11
FIG. 11A
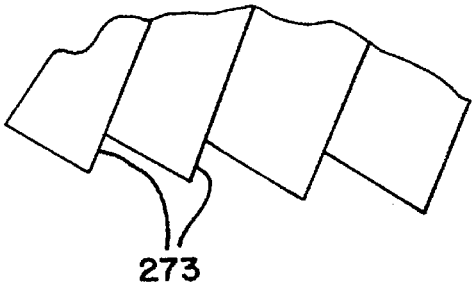
FIG. 12
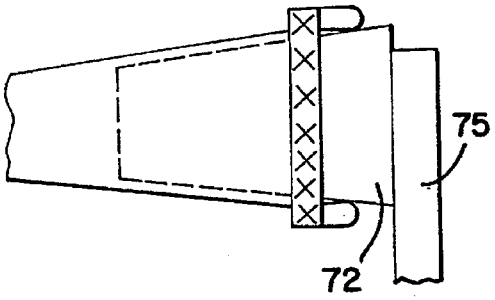
FIG. 13
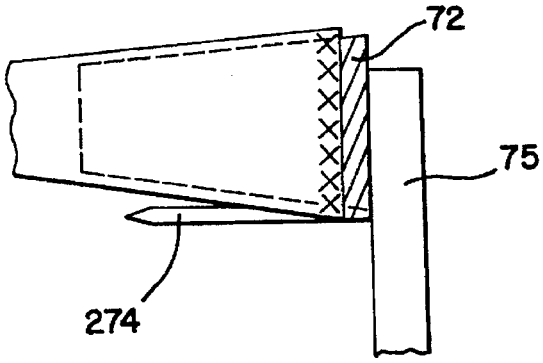

SEWING SLEEVES ON SHIRT BODIES

CROSS-REFERENCES

The present application is a continuation in part of application Ser. No. 08/311,330 filed Sep. 23, 1994, entitled "IMPROVED METHOD AND APPARATUS FOR SEWING SLEEVES ON SHIRT BODIES" currently pending (4720/98).

The present application is related to U.S. Pat. No. 5,251,557, entitled "SEWING MACHINE WITH AN EDGE GUIDING DEVICE TO GUIDE ONE OR MORE PLIES OF MATERIAL," that issued on Oct. 12, 1993, U.S. Pat. No. 4,512,268, entitled "METHOD AND APPARATUS FOR TENSIONING AND SEWING A TUBULAR WORKPIECE," that issued on Apr. 23, 1985, U.S. Pat. No. 4,479,447, entitled "METHOD AND APPARATUS FOR SEWING ON A TUBULAR WORKPIECE EDGE," that issued on Oct. 30, 1984 and U.S. Pat. No. 5,370,072, entitled "AUTOMATIC ALIGNMENT OF MATERIAL AND POSITIONING AT THE STITCH FORMING LOCATION", that issued on Dec. 6, 1994, All of these Patents and the pending application are incorporated herein by this reference.

BACKGROUND OF THE INVENTION

This invention relates to a machine and method for an operator to concurrently operate two sewing machines having automatic sew cycles for sewing sleeves onto shirt bodies. This invention has been developed for use with the method and apparatus disclosed in the above identified U.S. patent application Ser. No. 08/311,330 but could also be used with other machines that are intended to accomplish a similar result.

The operation performed by the machine disclosed in U.S. patent application Ser. No. 08/311,330 was, prior to the invention of that application, performed manually by a highly skilled sewing machine operator. The sewing machine and work handling mechanism of that application includes an automatic sew cycle that, after initiation, does not require assistance by the operator for an interim time period. However, the automatic sew cycle for the machine of U.S. patent application Ser. No. 08/311,330 is relatively short and not of sufficient duration to enable a skilled and efficient operator to handle material and load a second machine during the first machine's automatic sew cycle. Thus, an operator could concurrently operate two machines of the type disclose in that application however neither machine would be operating at its maximum rate.

For the foregoing reasons, there is a need for a machine and method that will enable an operator to load these semi-automatic machines in a time duration that approaches the automatic sew cycle time of the machines.

SUMMARY OF THE INVENTION

The present invention is directed to a machine and method that satisfies these needs. The basic machine disclosed in U.S. patent application Ser. No. 08/311,330 has been improved such that it is more efficient and easier for an operator to operate. An apparatus comprising material handling equipment at the work station of an operator who is running two set sleeve machines has also been developed. This material handling equipment enables the operator to perform the process of substantially loading one machine during the automatic sew cycle time of the other machine.

The apparatus and machines of this invention utilizes an operating system that receives inputs and sends outputs to the machines and apparatus in a cooperative fashion such that the operation of the machines and the apparatus is optimized.

The machine of this invention consists of material handling mechanisms that overlay the shirt tables of the set sleeve machines.

The machine of this invention consists of a operators work station between a first and a second set sleeve machine that are orientated such that their directions of loading are substantially opposite.

The machine of this invention consists of an operating system that receives and sends signals to the material handling equipment and to the set sleeve machines.

The machine of this invention consists of a sleeve tray for supporting a stack of sleeves and includes a sleeve picker that picks up the top sleeve from a stack and presents it for easy grasp by the operator.

The machine of this invention consists of a sleeve release sensor that is activated when the operator grasps a sleeve and signals the operating system that the cycle to grip and open another sleeve should be started.

The machine of this invention consists of a sleeve picker that is caused to release the sleeve that it is holding when a sensor is activated and to initiate the cycle to pick up the next sleeve from a stack of sleeves.

The machine of this invention consists of loader trays, for supporting stacks of shirt bodies, that are mounted for movement toward and away from the set sleeve machines.

The machine of this invention consists of an operating system that utilizes the sensors on the set sleeve machines that are actuated when the operator loads a sleeve on the machine's material handling mechanism.

The machine of this invention consists of an operating system that will cause the loader trays to move toward and then retract from the operator station when the machine's automatic sew cycle is initiated.

The machine of this invention consists of an operating system that will respond to a sensor that is actuated when the operator loads a shirt body on the set sleeve machine and will respond by initiating shirt body load functions and after the expiration of a delay period start the automatic sew cycle for the set sleeve machine.

The machine of this invention consists of an operating system that will cause the load trays to move toward the set sleeve machines when the set sleeve machine approach the end of their automatic sew cycles.

The machine of this invention consists of an unloader arm carried by the loader tray that drops down onto a shirt body and secures the shirt body between the unloader arm and the shirt table.

The machine of this invention consists of a mechanism that will automatically rotate the shirt body 180° after a first sleeve has been attached to the position for attaching the second sleeve.

BRIEF DESCRIPTION OF THE DRAWINGS

FIG. 11 is a schematic view of the mounting mechanisms for the front and rear tension rollers.

FIG. 11A is an enlarged view of an edge of the front tension roller, illustrating the spiral groove.

FIG. 12 is a schematic view of the front tension roller without an anti-roll bar having a garment loaded thereon including a folded over edge.

FIG. 13 is a schematic view of the front tension roller with an anti-roll bar having a garment loaded thereon in which the edge is not folded over.

DETAILED DESCRIPTION OF THE PREFERRED EMBODIMENT

Figure 1:
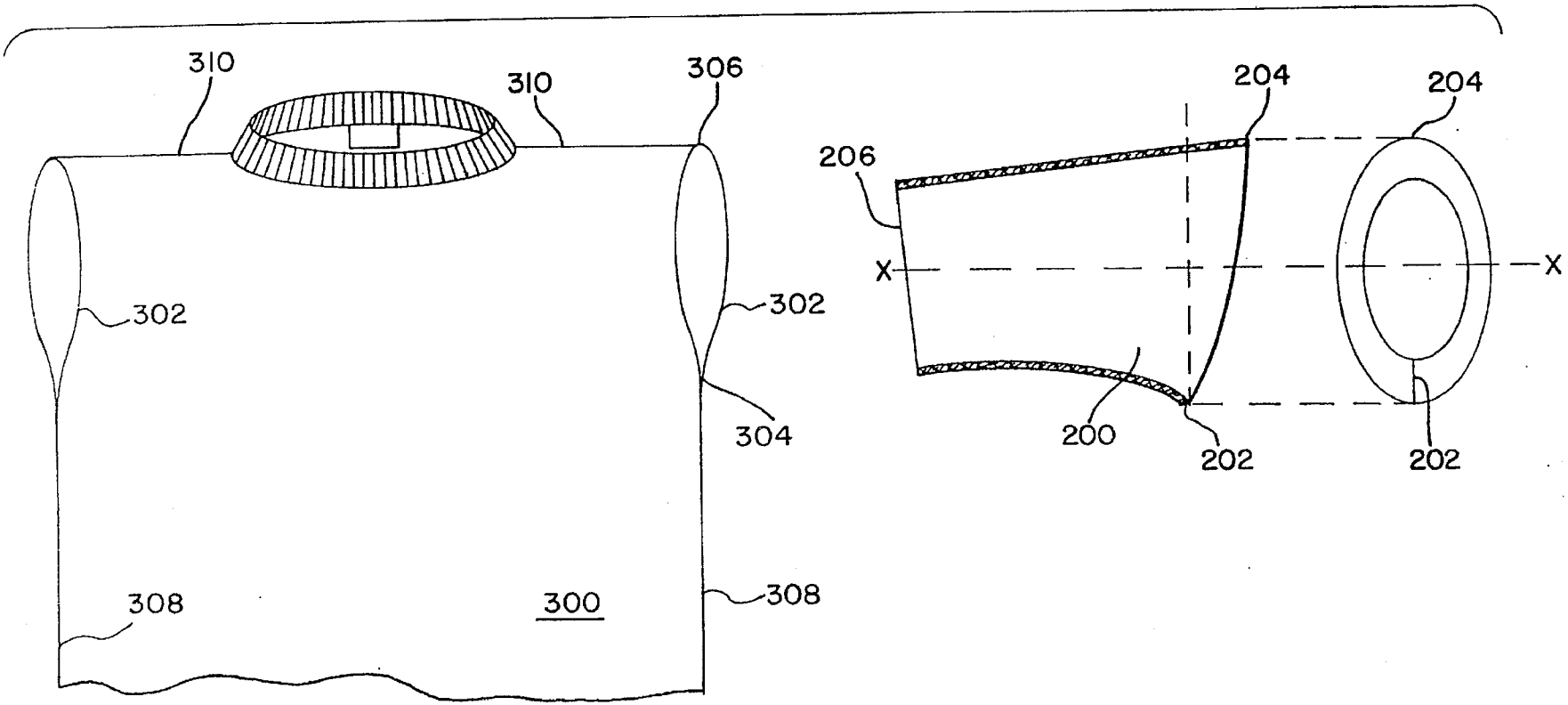
FIG. 1 is a top view of the unsewn shirt body and sleeve.

There is shown in FIG. 1 a shirt body 300 that is wrong side out and a sleeve 200 that is right side out. The shirt body 300 and sleeve 200 are presented to the operator, to be sewn together, in the condition shown in FIG. 1. The shirt body 300 has an arm hole 302 on each side. The arm holes 302 each have reference points that are referenced to herein as the body arm hole alignment point 304 and a shoulder seam point 306. The body arm hole alignment points 304 are at the intersection of the side seams 308 and the arm holes 302 and the shoulder seam points 306 are at the intersection of the shoulder seams 310 and arm holes 302.

The sleeve 200 has a hemmed end 206 and a arm hole end 204 that is to be connected to the arm holes 302 of the shirt body 300. Most garment sleeves taper down or are smaller along the sleeves' longitudinal axis X—X from the arm hole end 204 to the hemmed end 206. It is also the usual pattern for a sleeve that the arm hole end 204 have a generally elliptical shape and the ellipse is tilted relative to the longitudinal axis of the sleeve. Both the taper of the sleeve and the tilt of the elliptical shaped arm hole end 204 greatly complicate automating the sew cycle for setting sleeves. However, this invention includes features that overcome these complications. The loading end of rollers 80 and 72 are orientated such that rollers 80 and 72 usually converge. Roller 72 is mounted such that its orientation can be adjusted within a range from normal to the line of sew to approximately the same angle as is illustrated for roller 80.

Figure 2:
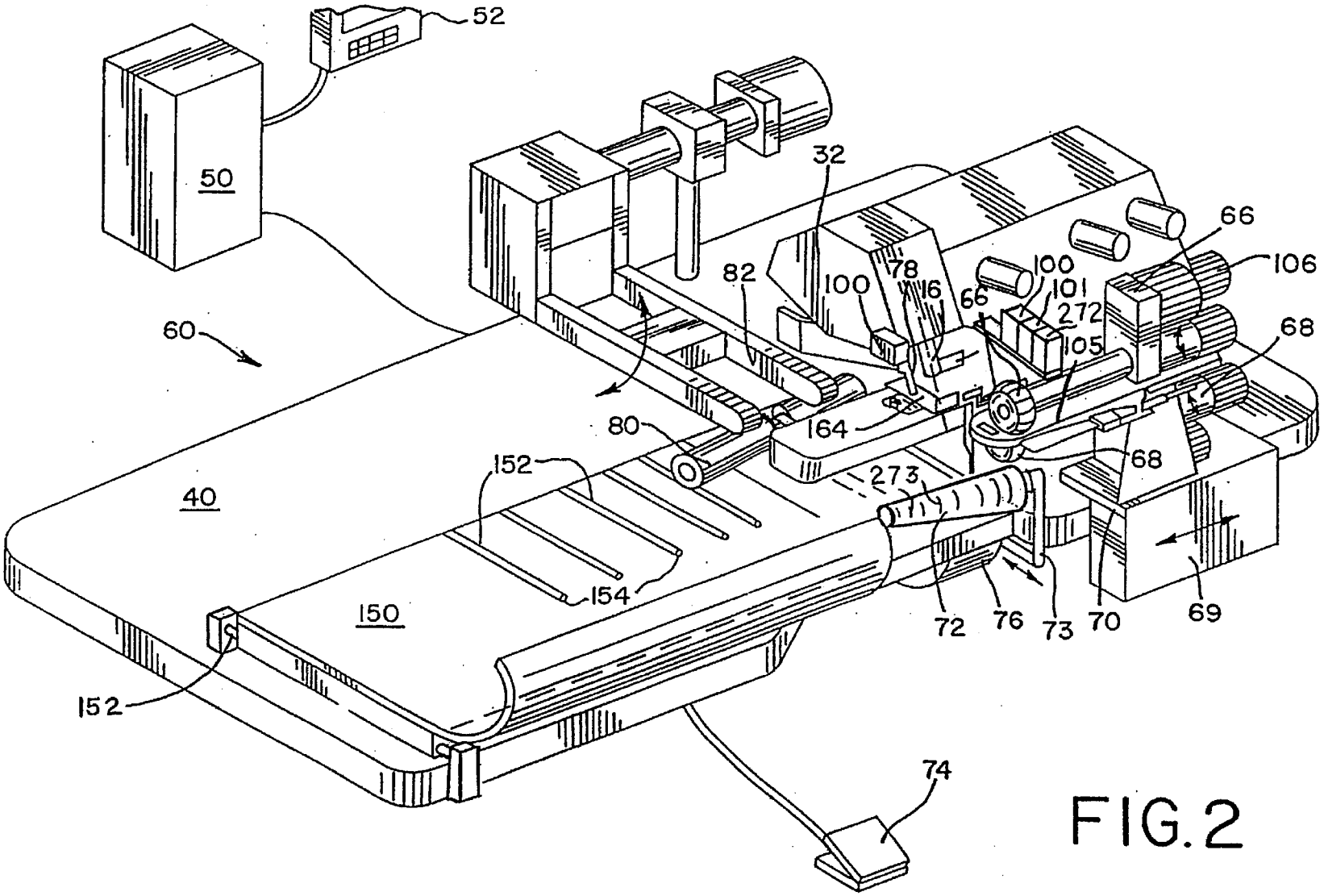
FIG. 2 is a perspective view of the sewing machine and material loading mechanism of this invention.

In the preferred embodiment a coarse guide sensor 272 is provided, see FIG. 2, that senses the marginal edge of the sleeve. If the sleeve creeps to the left the coarse guide sensor 272 is uncovered and causes the front tensioning roller 72 to be shifted to the right. When the coarse guide sensor 272 is covered the front tensioning roller 72 is caused to shift to the left. The front tension roller 72 is conical shaped and tapers down toward its loading end. A spiral groove 273 is formed in the conical surface of front tension roller 72 that provides an aggressive surface for engagement of the sleeve. Spiral groove 273 exerts a force on the sleeve tending to move it to the right. The arm hole end 204 of the sleeve 200 has a reference point referred to as the arm hole alignment point 202 or seam end point which must be aligned with the body arm hole alignment point 304 of the shirt body 300.

The term "margin edge" when used in this patent means the edge of the material that extends along the direction of material feed.

Referring to FIG. 2, the sewing machine 32 and work piece control and advancing mechanism 60 will be described. The sewing machine 32 is a conventional cylinder bed overedge type machine such as the Union Special Model SP161 machine and includes a needle 16 and a presser foot 164. The sewing machine 32 is driven by a sew motor 76 that can be actuated by a foot switch 74. When the sewing machine 32 is running the shaft encoder 106 sends pulses or signals to the microprocessor controller 50. Shaft encoder 106 sends a series of pulse for every rotation of the sewing machine motor, which is equal to one stitch being produced by the sewing machine. The microprocessor controller 50 then feeds the proper pulses to the edge guiders to keep them in feed or speed synchronization with the sewing speed or feed rate. Thus, regardless of changes in sewing speed, which can occur as a result of acceleration or deceleration of the sewing motor, the feeding guiders properly track the workpieces. This important feature of applicants invention eliminates over or under tensioning which could cause improper guiding and open seams, puckering or distortion in the seam or improper finished garment size.

The sewing machine 32 and the work piece control and advancing mechanism 60 are mounted on a frame 40. The workpiece control and advancing mechanism 60 includes an upper edge guider 66 and lower edge guider 68 that engage opposite sides of a double sided ply separator plate 143. Separator plate 143 is located forward of the stitch forming instruments. The upper edge guider 66, lower edge guider 68 and ply separator plate 143 are all mounted on an edge guider slide 69 which enables this assembly to slide into and out of the stitch forming line.

The work piece control and advancing mechanism 60 also includes a front tensioning roller 72, that rotates freely and is mounted on frame 40 forward of the edge guiders 66 and 68. Front tensioning roller 72 can be moved linearly in a fore and aft direction in response to the actuation of front tensioning roller cylinder 73. A stationary rear roller 80 is mounted rearwardly of the stitch forming instruments. As is best seen in FIGS. 2 and 11 the rear roller 80 has two sections and is journaled by a mounting arm 275 between the sections. The mounting arm 275 is secured to the frame 40. The ends 81 and 83 of the rear roller sections that are remote from the journaled mounting are free. The rear roller 80 converges such that its end 81 is closer to front roller 72 than its end 83. The converging ends of rollers 80 and 72 not only facilitate loading of the work pieces but also complement the downward taper of the sleeves from their arm hole ends. When front tensioning roller is retracted to its load position it has moved closer to the rear roller 80 making it easier to load the sleeve 200. As a result of the converging arrangement of rollers 80 and 72 there is a tendency for the work product to creep toward the loading ends of the rollers 72 and 80 as it is fed around on the rollers. A coarse guide sensor 272 is provided that senses the edge of the garment. If the garment creeps to the left the coarse guide sensor 272 is uncovered and causes the front tensioning roller 72 to be shifted to the right. When the coarse guide sensor 272 is covered the front tensioning roller 72 is caused to shift to the left. In addition to compensating for the tendency to creep, shifting the roller to the right also accommodates for the taper of the sleeve and for the tilt of the elliptically shaped arm hole end. The spiral groove 273 formed in the surface of front tensioning roller 72 provides an aggressive surface for controlling the sleeve and exerts a force on the sleeve to move to the right.

It has been found that as the beginning of the seam encounters the front tensioning roller 72 the garment had a tendency to roll over, as illustrated in FIG. 12, as it comes around the roller 72. To prevent this unacceptable rolling over an anti-roll bar 274 is provided. The anti-roll bar 274 is mounted for vertical movement on the mounting bracket 75 that supports the front roller 72. An air cylinder 77 is provided, on mounting bracket 75, for shifting the anti-roll bar 274 up and down relative to the roller 72. During the sewing operation the anti-roll bar 274 is located in the area where the beginning of the seam first encounters the front tensioning roller 72. The anti-roll bar 274 engages the exterior of the garment, see FIG. 13, and holds the beginning of the seam flat against the surface of the front tensioning roller 72, during the initial encounter. The anti-roll bar 274 prevents the edge from rolling over for the entire period during which the beginning of the seam is in contact with the front tensioning roller 72. The anti-roll bar 274 can be moved down such that it is remote from the front tensioning roller 72 during the loading of the sleeve 200 and shirt body 300 over the rollers 72 and 80. This feature has the advantage of moving the anti-roll bar 274 out of way during the loading operation and provides for easy loading of the sleeve and shirt body. FIG. 13 is an illustration of the garment on the front tensioning roller 72, during the sewing operation with the anti-roll bar 274 in place. FIG. 13 illustrates the improvement that is obtained by the anti-roll bar 274 as compared to the rolled over edge that is illustrated in FIG. 12.

A chain cutter 78 is provided to sever the chain that attaches a finished work product to the sewing operation.

A side feed puller 82 having a pair of track type pullers is pivoted on the frame 40 at its end that is most remote from the stitch forming instruments. The free end of the side feed puller 82 overlies the rear roller 80 and functions to pull the work piece through the machine when lowered into contact with the work piece that is wrapped around rear roller 80.

As best seen in FIG. 2 a table 150 having a flat upper surface that merges into a semi-cylindrical extension of the flat upper surface is supported on the frame 40 at a location to underlay the bulky end of a shirt being sewn.

The table 150 is mounted on a pivot shaft 152 to the frame 40 at its end remote from the sew area. This pivot mounting of the table 150 permits the end of the table 150 that is adjacent to the sew area to be lowered during the loading operation of the rollers 72, 80. Thus, during the automatic sew cycle prior to loading a sleeve 200 or a shirt body 300 on the rollers 72, 80 the table 150 is lowered about the pivot shaft 152 to make the area around the rollers 72, 80 more accessible to the operator.

There are a series of air blowers 152 on its top surface of table 150. The air blowers 152 are disclosed as tubes connected to the top surface of table 150 and have open discharge ends 154 through which air under pressure is discharged. The air blowers 152 are turned on at the same time that the uncurling blowers 105 are activated. The air streams flow along the top surface of the support plate and up the cylindrical surface. The air streams flow in the direction that the bottom rung of shirt body 300 is moving during the sewing operation. The air streams suspend the shirt body 300 over the surface of the support plate and assists in feeding the bulky mass of the bottom of the shirt during the sewing operation. This air stream assist prevents the shirt bottom from twisting about itself and creating a resistance to the operation of the edge guiders which would cause an open or irregular seams. The same results could be accomplished by mechanical devices such as mechanical rotary clamps or upper and lower opposing drive belts.

The shirt body 300 and sleeve 200 are presented to the operator as shown in FIG. 1. The cycle is initiated by the operator selecting "Automatic Mode" from the microprocessor 50 control panel. This prepares the machine for loading by raising the side feed puller 82 and retracting the front tensioning roller 72. The presser foot 164 is in the raised or up position. In accordance with the preferred embodiment for loading the shirt body 300 and sleeve 200, the operator picks up a sleeve 200, turns it right side out and loads it over the front tensioning roller 72 and rear roller 80. In loading the sleeve 200 the operator orientates the arm hole alignment point 202 to the needle. The sleeve 200 is loaded under the raised presser foot by the operator. When the operator has located the arm hole alignment point 202 under the presser foot, the sleeve sensor 100 is covered which sends a signal to the microprocessor 50 which causes the presser foot to lower and the roller cylinder 73 to partially extend which in turn causes the front tensioning roller 72 to extend and stretch the sleeve 200. When the sleeve sensor 100 is covered the edge guiders 66 and 68 are also caused to move into the sew area.

Figure 10A:
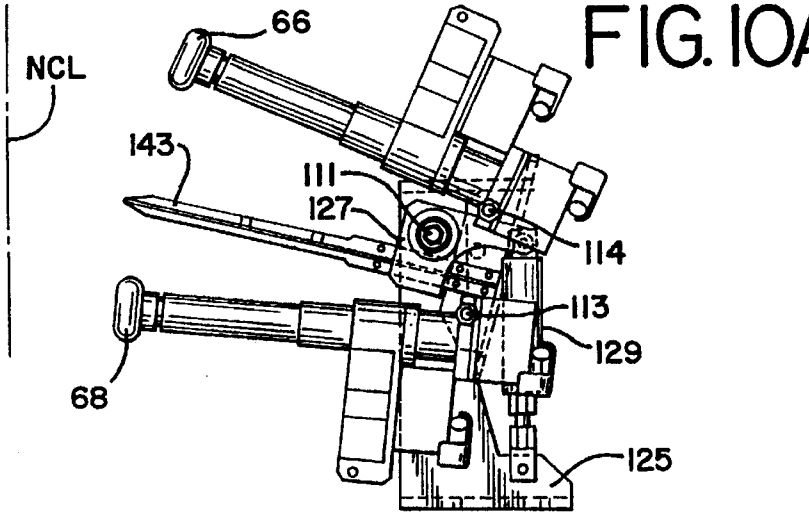
FIG. 10A is an isolated view of the top and bottom edge guiders of this invention outside of the sew area prior to the sleeve load.
Figure 10B:
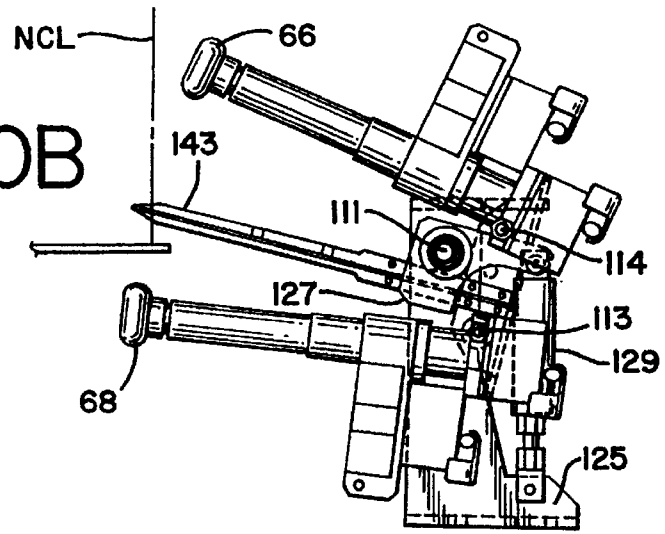
FIG. 10B is an isolated view of the top and bottom edge guiders of this invention, located in the sew area, after the sleeve load sensor has been activated.
Figure 10C:
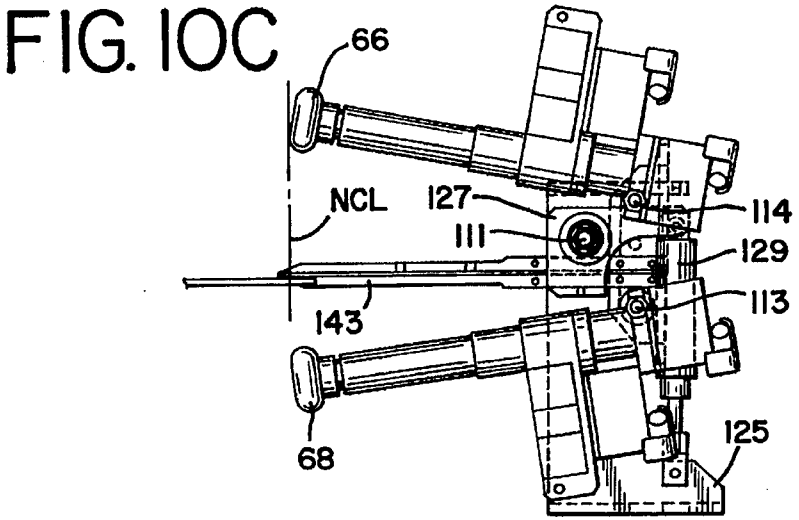
FIG. 10C is an isolated view of the top and bottom edge guiders of this invention, located in the sew area, after the edge guider has pivoted down.
Figure 10D:
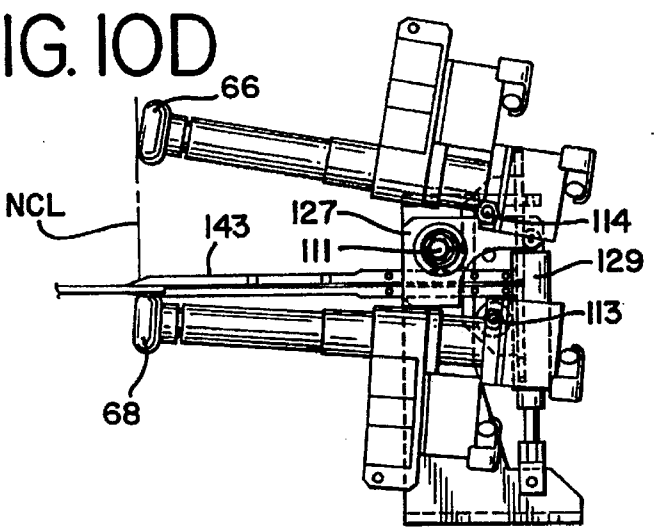
FIG. 10D is an isolated view of the top and bottom edge guiders of this invention, located in the sew area, after the lower edge guider has closed to clamp the sleeve.

As best seen in the series of FIGS. 10A through 10C the upper edge guider 66, lower edge guider 68 and ply separator plate 143 are each mounted about pivot axes 114, 113 and 111 respectively. The edge guide mechanism also includes pivot mechanisms that can be activated to cause the upper edge guider 66, lower edge guider 68 and the ply separator plate 143 to pivot about their pivot axes 114, 113 and 111. In FIG. 10A, the needle's center line is designated NCL, and the edge guider assembly is shown, at its retracted position out of the sew area. The edge guiders 66 and 68 are mounted on an upright standard 125. A mounting member 127 is pivotally mounted on the upper end of upright standard 125 about the pivot shaft 111. An air cylinder 129 is anchored to the upright standard 125 and is connected at its rod end to the mounting member 127. Expansion and contraction of the cylinder 129 pivots mounting member 127 about pivot shaft 111. The ply separator plate 143 is secured to the mounting member 127 and thus pivots with mounting member 127. The upper edge guider 66 is pivotally connected to the mounting member pivot shaft 114 and the lower edge guider 68 is pivotally connected to the mounting member 127 about pivot shaft 113. The edge guiders 66 and 68 can independently pivot about shafts 114 and 113 relative to the mounting member 127. When the edge guider assembly is in the FIG. 10A position the upper edge guider 66, lower edge guider 68 and ply separator plate 143 are each inclined relative to the horizontal. In FIG. 10B the edge guider assembly has, in response to the sleeve covering the sleeve load sensor 100, shifted into the sew area. The attitude of the upper edge guider 66, lower edge guider 68 and ply separator plate 143 remain the same as seen in FIG. 10A. As a result of the ply separator plate being pivoted up, the edge of sleeve 200 clears the ply separator plate 143. The edge guider assembly is then pivoted down, see FIG. 10C, causing ply separator plate 143 to contact the sleeve 200. The lower edge guider 68 then closes or pivots up, as illustrated in FIG. 10D, to thus clamp the sleeve between the bottom surface of ply separator plate 143 and the lower edge guider 68. As shown in this series of Figures the edge of the arm hole end 204 is located on the bottom surface of the double sided ply separator plate 143 where it will be engaged by the lower edge guider 68.

Following the sleeve loading function there is a delay after which the presser foot 164 is raised to allow the shirt body 300 to be loaded. The shirt body 300 is then loaded, wrong side out, over the sleeve 200 and its arm hole alignment point 304 is orientated with the sleeve's arm hole alignment point 202. The aligned alignment points 202 and 304 are held under the presser foot 164 and the edge of the arm hole 302 is placed on the upper surface of the double sided ply separator plate 143. A shirt body load sensor 101 is covered when loading the shirt body 300 which causes the presser foot 164, upper edge guide 66 and the side feed puller 82 to lower. The front roller 72 also, at this time, shifts to the right to its sew position. The table 150 is then raised in preparation for sewing. As the table 150 is raised the anti-roll bar 274 is also raised to a position at which it engages the lower rung of the shirt body 300 adjacent the roller 72. After a timed delay sewing begins.

After the shirt body 300 and a sleeve 200 are loaded a time delay starts an automatic sewing cycle and chain cutting operation. The automatic sewing cycle and chain cutting operation is a hands off operation and does not require the assistance or attention of the operator. When the automatic sewing cycle and chain cutting operation is completed the sewn product is removed by an unloading mechanism and the process is repeated for the other armhole 302 and another sleeve 200.

The upper edge guider 66, shown in FIG. 6, and lower edge guider 68 are functionally identical and thus only the upper edge guider 66 will be discussed in detail. It should be noted that the edge guiding devices used in this application are substantially the same as those disclosed in the above identified U.S. Pat. Nos. 5,251,557, 4,512,268, 4,479,447 and U.S. application Ser. No. 08/123,000 and reference may be had to those patents for a more complete disclosure of the structural components of these devices.

Figure 6:
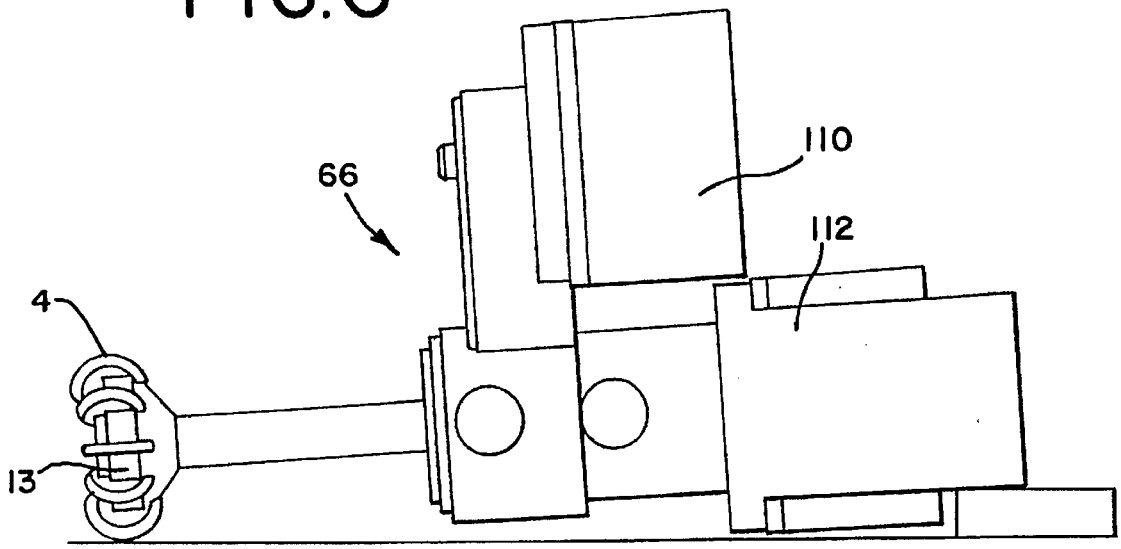
FIG. 6 is a side view of an edge guiding device of the type used in the automatic ply aligning and positioning mechanism of this invention.

Referring now to FIG. 6, the upper edge guider 66 has a first stepper motor 110 for driving the feeding wheel 13 that functions to advance the ply of material in the material feed direction and a second stepper motor 112 for driving the gripper wheels 4 that function to move the ply of material normal to the material feed direction. The stepper motors 110 and 112, can be controlled to rotate a specific number of rotations or fraction of a rotation. Thus, depending upon the diameter of the drive element and the drive ratios, a ply of material can be advanced a specific distance upon transmitting an actuation instructions to the stepper motor to run a specific number of steps.

The entire upper edge guider 66 is supported at one end on a horizontal pivot shaft 114. The other end, which is the material engaging head of the device, rest on the ply separator plate 143. The material engaging head can be lifted off the ply separator plate 143 by pivoting the entire device about horizontal pivot shaft 114. The top edge guider 66 can rely upon gravity or can include a mechanical device, such as a spring or an air cylinder, to assist in forcing the material engaging head into contact with the ply separator plate 143. The lower edge guider 68 must include a mechanical device, such as a spring or air cylinder, to bias its material engaging head into contact with its ply separator plate 143. The upper edge guider 66, lower edge guider 68 and ply separator plate 143 are mounted on an edge guider slide 69 (see FIG. 2) such that they can be automatically moved horizontally, to shift them between operative and inoperative locations.

Figure 7:
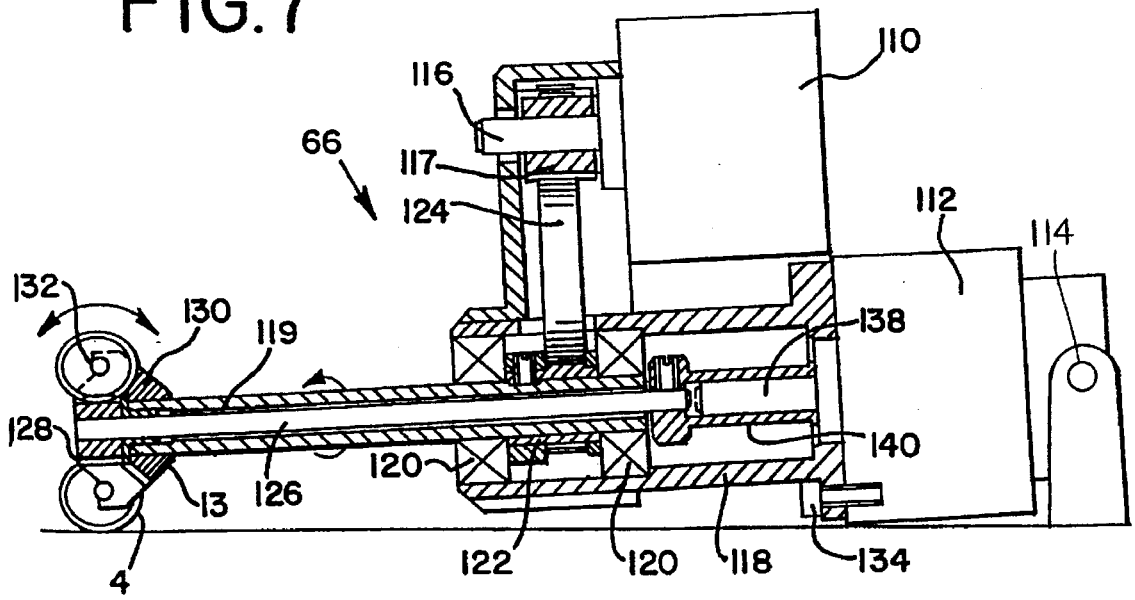
FIG. 7 is a cross section view of the edge guiding device seen in FIG. 6.

FIG. 7 is a cross section view of the top edge guider 66 seen in FIG. 6. A housing 118 has the first stepper motor 110 mounted to its outer surface. First stepper motor 110 has an output shaft 116 with a pinion 117 secured thereto. A hollow shaft 119 is mounted for rotation by bearings 120 in the housing 118 and has a pinion 122 secured thereto. Pinion 122 is mechanically connected by way of a toothed belt 124 to pinion 117. Rotary drive is transmitted from stepper motor 110 through toothed belt 124 to the hollow shaft 119. A feeding wheel 13 is fixed to the free end of hollow shaft 119 and thus rotates therewith. The feeding wheel 13 has a plurality of openings 130 formed therein in which gripper wheels 4 are mounted for rotation on shafts 132. The peripheral edges of gripper wheels 4 are in driving engagement with worm gear 128 and are caused to rotate thereby. Worm gear 128 is secured to the free end of shaft 126 that is mounted for rotation within the hollow shaft 119.

The housing 118 is secured to one end of second stepper motor 112 by bolts 134. The other end of second stepper motor 112 is pivotally mounted to the base 104 of the sewing machine 32 about a pivot shaft 114. The output shaft 138 of second stepper motor 112 is secured to shaft 126 by a coupler 140. The feeding wheel 13 of top edge guider 66 can be lifted off ply separator plate 143 by pivoting the edge guider 62 upwardly about shaft 114.

Figure 8:
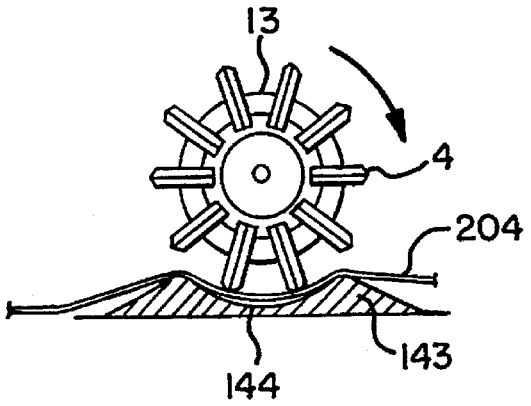
FIG. 8 is an end view of the feeding and gripper wheel head of the edge guiding device seen in FIG. 6.

FIG. 8, which is an end view of the feeding wheel 13, includes a ply of material designated 204, which is the arm hole end of the sleeve 200. The arm hole end 204 is located between the peripheral edge of feeding wheel 13 and the ply separator plate 143. Ply separator plate 143 has a cylindrical shaped concave surface 144 that cooperates with the peripheral edges of gripper wheels 4 to grip the material 142 so as to feed it in the precise amount intended. As a result of the concave shape of surface 144 a plurality of gripper wheels 4 can be in engagement with the sleeve material 204 at the same time which enhance the control and precision of this feed.

The sensors used with the edge guiders of this invention are of the retro-reflective type in which emitted rays are reflected back to the sensor. The emitted rays are directed at a highly reflective surface, or a surface to which reflective tape has been applied. When the ply of material moves into the area where the rays are directed there is a change in the rays that are reflected back to the sensor. This change is detected by the sensor and the change is transmitted to the control system.

Diffuse type sensors could also be used. Diffuse type sensors recognize characteristics of a particular type of surface that they are intended to sense and do not require the presence of a highly reflective surface.

It is important to the operation of this invention that the sensors for all edge guiders be directionally coordinated such that they all attempt to guide the material edge that they are monitoring the same distance from the line of stitching. If the aim of one sensor is off, in the direction that will cause the marginal edge of the material to be spaced from the stitch line a greater distance than for the other layers of fabric, then a wide ribbon of excess waste material will be trimmed from the one layer. This is unacceptable because of the material that is wasted. However, if the aim of one sensor is off in the other direction, such that the material edge being monitored by this sensor is missed by the line of stitches then the seam is defective and the completed piece must be rejected.

Figure 9:
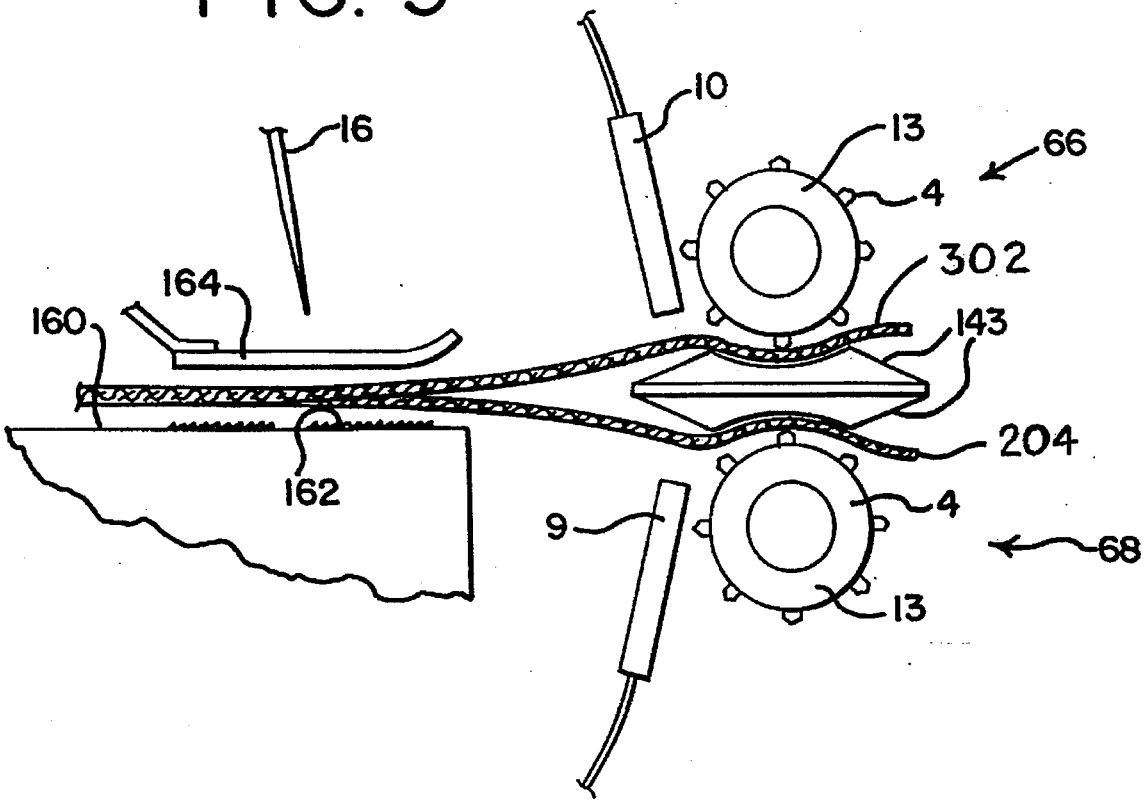
FIG. 9 is a diagrammatic end view illustration of the material loading and stitch forming areas of the sewing machine seen in FIG. 2.

FIG. 9, which is a diagrammatic end view illustration of the material loading and stitch forming areas of the sewing machine seen in FIG. 2, discloses the feeding wheels 13 and gripper wheels for both the upper edge gripper 66 and the lower edge gripper 68 in engagement with the material of the shirt body 300 and sleeve 200 respectfully. The two sided ply separator plate 143, upper edge sensor 10 and lower edge sensor 9 are also shown in this view. The material 302 and 204 is shown between the raised presser foot 164 and throat plate 160. The needle 16 and the upper portions of the feed dog 162 is also visible in this view. When the upper and lower edge sensors 10 and 9 are not covered by the material 204 and 302 the gripper wheels 4 independently rotate in the direction to feed the material toward the point that their corresponding sensor is directed. When the material has been moved by the gripper wheels 4 in that direction sufficient to cover the area that their corresponding sensor is directed, then the rotation of wheels 4 is reversed and the material is fed in the opposite direction. This uncovers the sensor which results in reversing the direction of feed of the gripper wheels 4. Thus the gripper wheels 4 are continuously causing the sensors 9 and 10 to be covered and uncovered which in turn continuously reverse the direction of rotation of gripper wheels 4 and maintain the marginal edges of the material 204 and 302 in proper alignment with the needle 16.

In addition to guiding the workpiece edges the microprocessor controller 50 monitors the edge guider sensors 9 and 10 to determine if the edges of the arm hole end 204 and arm hole 302 are being controlled. If there are no transitions in signal levels within a certain number of stitch counts during the sewing cycle, the microprocessor controller 50 will stop the operation and send a signal to the operator to identify and resolve any problem. The microprocessor controller 50 will resume the operation after the edge sensors are again transmitting signals at the proper level. This is very important to the proper operation of this invention since it provided a means to prevent open seams in the garments. In the garment manufacturing industry an open seam is considered the most serious product defect.

Figure 3:
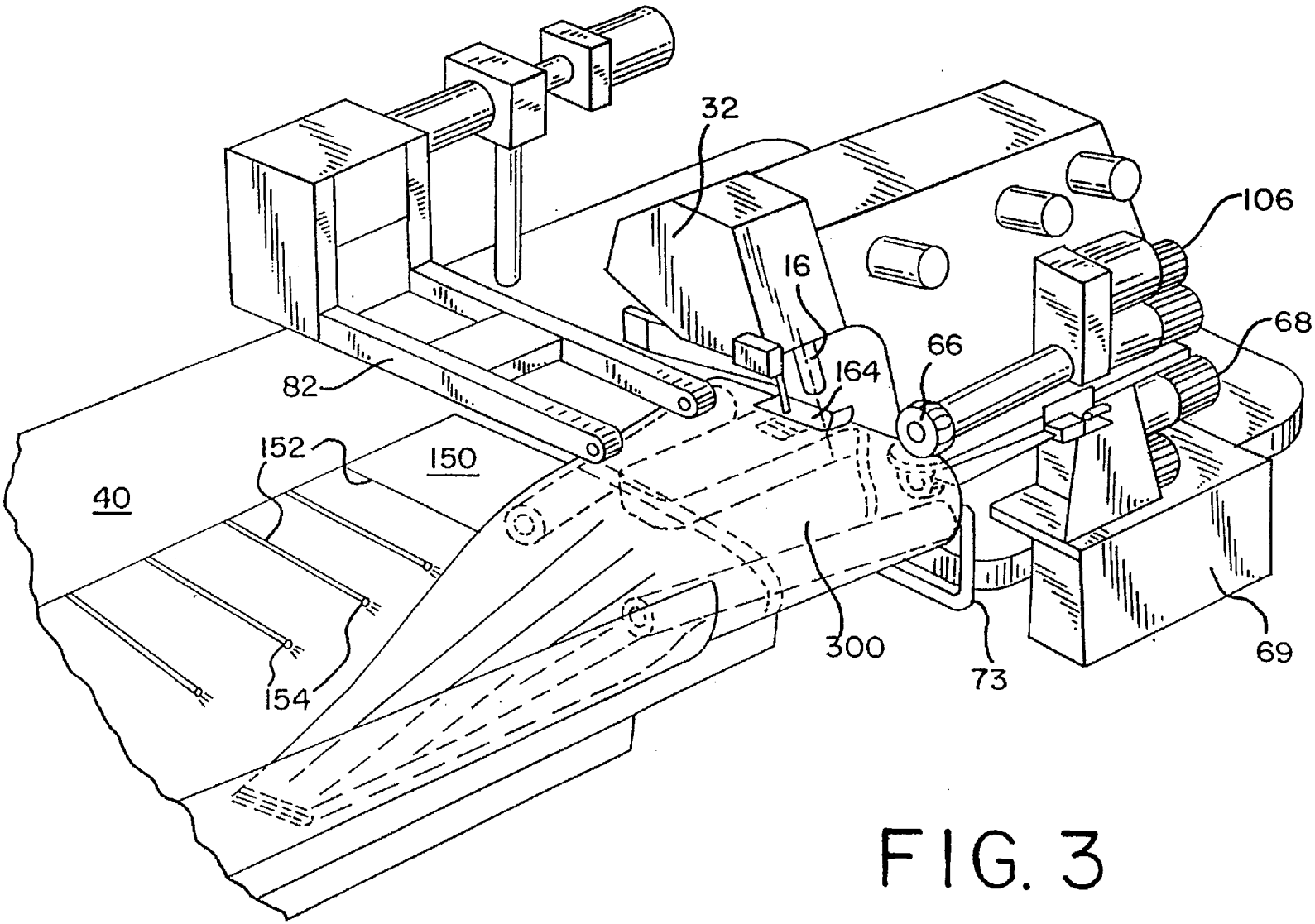
FIG. 3 is a perspective view of the sewing machine and material handling mechanism of this invention with the shirt body and sleeve loaded and ready to be sewn.

FIG. 3 is a perspective view of the sewing machine and material handling mechanism of this invention with the shirt body and sleeve loaded and ready to be sewn. At this point in the operation the gripper wheels 4 have aligned the edges of the sleeve arm hole 204 and the body arm hole 302 and the edge guiders 66 and 68 are in place. Also, the side feed puller 82 has been lowered into engagement with the top surface of the shirt body 300. Both the shirt body 300 and the sleeve 200 are between the side feed puller 82 and the rear roller 80. A time delay begins after the shirt body 300 is loaded. At the expiration of this time delay the machine's automatic sew cycle begins. However, after the operator loads the shirt body 300 the operator is free to prepare for the next loading operation on the other machine. Table 150, its series of air blowers 152 and semi-cylindrical extension are seen in this view. The air blowers 152 create a moving air flow below the bulky end of a shirt that assist in the rotation of the bottom end on the shirt.

The air streams flow in the direction that the bottom rung of shirt body 300 is moving during the sewing operation.

Figure 4:
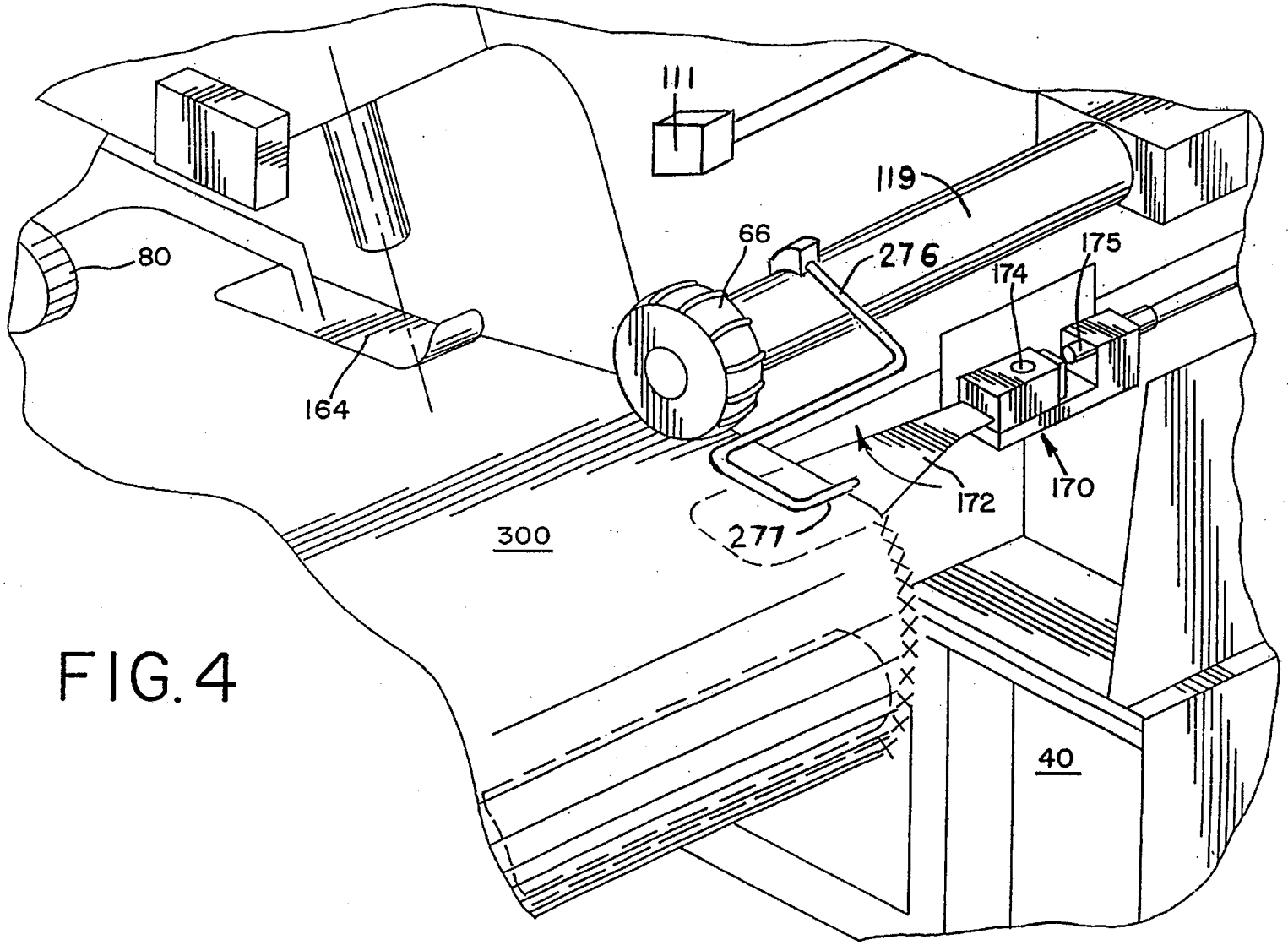
FIG. 4 is an enlarged perspective view of the seam detector mechanism and the surrounding sewing machine and material handling mechanism of this invention.

FIG. 4 is an enlarged perspective view of the seam detector mechanism 170 about to be engaged by the sewn seam. As seen in FIG. 4 the automatic sew cycle is in progress and the beginning of the seam is approaching the edge guider mechanisms 66 and 68. Since the plies 302 and 204 have been stitched together they can not be fed to both surfaces of the ply separator plate 143. The seam detector mechanism 170 thus must be located forward of the edge guiders 66 and 68 and ply separator plate 143. The seam detector mechanism 170 includes a seam detector lever 172 that is pivotally mounted about sensor pivot 174 on a proximity sensor 175. The seam detector lever 172 is constructed of a sheet material such as stainless steel that is horizontally arranged and is located such that the shirt body 300 passes over its upper surface and the sleeve 200 passes beneath its lower surface. As illustrated in FIG. 4, when the beginning of the sewn seam reaches the forward edge of the seam detector lever 172 it causes seam detector lever 172 to pivot to the rear about its sensor pivot 174. This rearward pivoting of the seam detector lever 172 activates the proximity sensor 175 which sends a signal to the microprocessor controller 50 which in turn sends a signal to actuate the edge guider slide 69. When the edge guider slide 69 is actuated it causes the upper 66 and lower 68 edge guiders along with the ply separator plate 143 to be retracted back out of the stitch formation line and also stops the sewing function. Actuation of the proximity sensor 175 also initiates a time delay after which the edge guiders 66 and 68 are returned to sew area and the sewing operation is resumed for a predetermined stitch count. At the end of the predetermined stitch count, the upper edge guider 66 which will cause stitching to stop after a specific number of stitches have been completed.

There is also illustrated in FIG. 4 a knockdown wire 276 that is mounted on the hollow shaft 119 of the upper edge guider 66. The knockdown wire 276 is constructed of spring wire that has been formed to include a garment engaging free end portion 277. The garment engaging free end portion 277 engages the upper surface of the garment before it is engaged by the gripper wheels 4. The end of sew sensor 11, which controls the upper edge guider 66 is illustrated in FIG. 4 and will be discussed in greater detail later in the specification.

Figure 5:
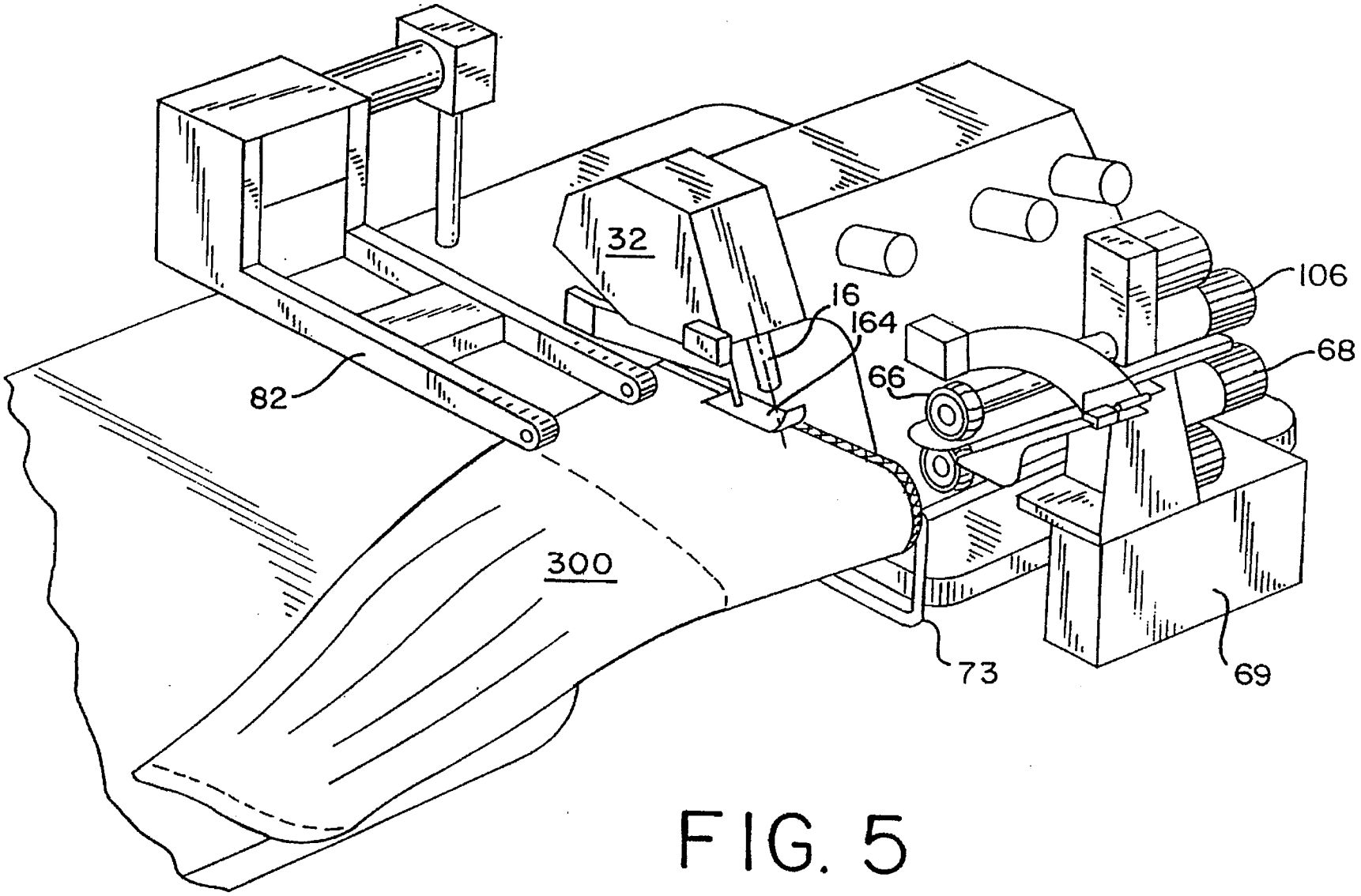
FIG. 5 is a perspective view of the sewing machine and material handling mechanism of this invention with the shirt body and sleeve loaded and approaching the end of the sewing cycle.

FIG. 5 is a perspective view of the sewing machine 32 and material handling mechanism 60 of this invention with the shirt body 300 and sleeve 200 loaded and approaching the end of the sewing cycle. Figure S shows the mechanism as they are located immediately after the seam detector 170 was actuated and the upper edge guider 66 and lower edge guider 68 along with the ply separator plate 143 having been retracted out of the line of stitch. The feeding and guiding function of the edge guiders 66 and 68 is stopped as is the sewing operation. After a short delay the edge guiders 66 and 68 are returned to the sew area and sewing is resumed and continues for a set number of stitches. When the upper edge guider 66 is returned and comes down on the garment the free end of the knock down wire 276 engages the upper surface of the garment and functions to hold the garment edge stable and ensures smooth sewing from this point to the end of the sew operation. At this time both sewn plies 302 and 204 are on the upper surface of the ply separator plate 143 and under the upper edge guider 66. The edge guiders 66 and 68 were under the control of the upper edge guide sensor 10 and lower edge guide sensor 9 prior to the actuation of the seam detect after which they are under the control of an end of sew sensor 11 (FIG. 4). While utilizing the edge guide sensors 9 and 10 the marginal edges of the sleeve 200 and shirt body 300 are being trimmed, however after the beginning of the seam is detected the edge trimming is halted and upper edge guider 66 is controlled by the end of sew sensor 11. The end of sew sensor is directed at a point that is to the rear of and slightly to the left of the point where the upper edge guide sensor 10 is directed. After a predetermined sewing period the upper edge guider 66 ejects the material edge to the left of the needle 16 while the sewing machine continues to operate producing a stitch chain that is connected to the sewn garment. An air cylinder 108 is mounted to the right and in the front of the needle 16 that has a hook or finger that moves along the work surface in a direction normal to the direction of feed of the garment. Air cylinder 108, which is activated independently of the upper edge guider 66, prevents the garment from returning to the sew area. The hook or finger engages the marginal edge of the garment to insure that it does not return to the sew area. The stitch chain that is attached to the garment must be severed to remove the sewn garment from the sewing machine 32. After a predetermined delay the chain is sucked into the inlet of the chain cutter 78 and the chain is severed. After another delay, sewing is stopped, the presser foot 164 is raised and the garment is free to be removed. The operator then repeats the same sequence for the other arm hole.

The operation of the sleeve setting process will now be discussed. The operator begins this process by loading a sleeve 200 under the presser foot 164. The sleeve sensor 100 is covered in this process which sends a signal to the microprocessor 50 which causes the roller cylinder 73 to partially extend which in turn causes the front tensioning roller 72 to extend and stretch the sleeve 200. The sleeve 200 is located under the raised presser foot. The presser foot lowers to hold the ply of material in the loaded position.

The shirt body 300 is loaded in the next stage. A shirt body load sensor 101 is actuated upon beginning this stage. The presser foot and feed puller are automatically lowered and the tensioning roller 72 is extended and the table 150 is raised at the appropriate time.

After a time delay of appropriate length the automatic sew cycle begins. The time delay initiates the extension of roller cylinder 73 which will cause front tensioning roller 72 to move horizontally from its load position to its sew position and to stretch the work pieces that are mounted over rollers 72 and 80.

The uncurling blowers 105 and the air blowers 152 are turned on. The upper edge guider 66 is moved to its down position at which it engages the material plies on the opposite surfaces of the ply separator plate 143. Although the operative end of the lower edge guider 68 actually moves up rather than down to reach its down position its position at which the material ply is pressed between it and the lower surface of the ply separator plate 143 is herein referred to as its down position.

The side feed puller 82 moves to its down position at which the two plies of material are pressed between it and rear roller 80. Also, the chain cutter 78 and the waste material removal mechanism are activated.

The edge guiders 66 and 68 do not necessarily begin their guiding function immediately after being moved to their down position. There is a time delay before upper 66 and lower 68 edge guiders start their feeding function.

The front tensioning roller 72 is in its sew position when sewing is started. The work piece has a tendency to drift toward the left from the position where it was loaded on rollers 72 and 80. To counteract this, tensioning roller 72 is shifted to the right/left in response to the coarse guides sensor 272 (see FIG. 9).

A seam detector 170 is activated by the finished seam when the finished seam is returning toward the edge guiders 66 and 68. Actuation of the seam detector 170 sends a signal to the microprocessor 50 which causes the edge guiders 66 and 68 to be raised away from the ply separator plate 143. Actuation of the seam detector 170 also actuates the edge guider slide 69 which moves the edge guiders 66 and 68 along with the double sided ply separator plate 143 out of the sew area. After a programmed time period the edge guiders 66 and 68 and the double sided ply separator plate 143 are returned to the sew area. The uncurling blowers 105 are also turned off during this operation.

When the edge guiders 66 and 68 are returned to the sew area both plies of material, the shirt body 300 and the sleeve 200, are on the upper surface of the double sided ply separator plate 143 and their sewn edge is under the control of the upper edge guider 66. The lower edge guider 68 is also closed at this point to clear the bottom plies of material, however, there is no material under it. The edge guiders 66 and 68 were under the control of the upper edge guide sensor 10 and lower edge guide sensor 9 prior to the actuation of the seam detector 170 after which they are under the control of an end of sew sensor 11. While utilizing the edge guide sensors 9 and 10 the marginal edges of the sleeve 200 and shirt body 300 are being trimmed. However, after the beginning of the seam has been detected, the edge trimming is halted and upper edge guider 66 is controlled by the end of sew sensor 11. The end of sew sensor 11 is directed to a point that is to the rear of and slightly to the left of the point where the upper edge guide sensor 10 is directed.

After the edge guide assembly has returned to the sew area and the end of sew cycle has began there is a period, measured in stitches, after which the upper edge guider 66 will eject the garment that is under its control out to the left. When the garment is forced out from under the presser foot 164 the sewing head continues to operate to form a chain. At the same time that upper edge guider 66 ejects the garment out from under the presser foot 164 the air cylinder 108 is activated which causes a hook or finger 109 to move laterally of the direction of material feed, engage the marginal edge of the garment to assist and insure its ejection from the sew area.

When the seam detector 170 is activated the sewing head is immediately stopped for a short time period. Also at this moment a time period is established for stopping the automatic sewing cycle.

All of the parameters such as speeds, delay periods, time periods, stitch counts and encoder pulse numbers that go into the timing diagram can be changed and are programmable through the microprocessor control panel. This is a very important feature of this machine since it allows the machine to be used for all sizes and numerous styles of apparel.

FIGS. 14–18 illustrate a work station that includes two sleeve setting sewing machines including the material loading mechanism described previously as well as a sleeve pickup device and loader trays that will enable an operator to efficiently run both machines.

Figure 14:
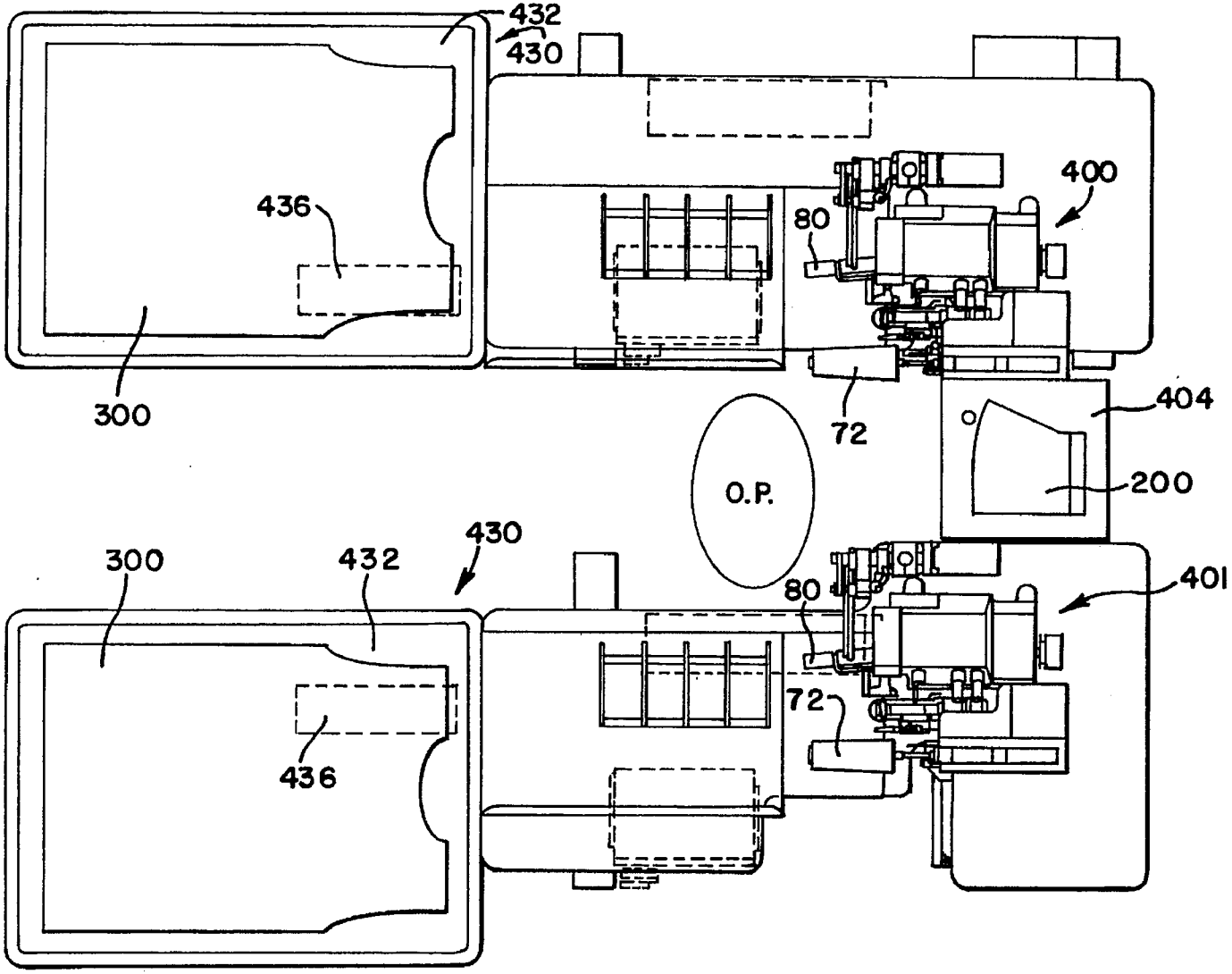
FIG. 14 is a plan view of the work station including two sleeve setting machines and including the sleeve pickup device and the loader trays.

There is shown in FIG. 14 an operator's work station including material handing equipment that will enable a single operator to concurrently operate two sleeve setting machines of the type previously disclosed. The operator is located at a position designated O.P. between two sleeve set machines, a left hand configured machine designated 400 and a right hand configured machine designated 401. During operation both machines 400 and 401 are placed in automatic mode. In the following discussion machine 401 is loaded first and will also be referred to as machine one. Machine 400 that is loaded second will also be refereed to as machine two.

Figure 15:
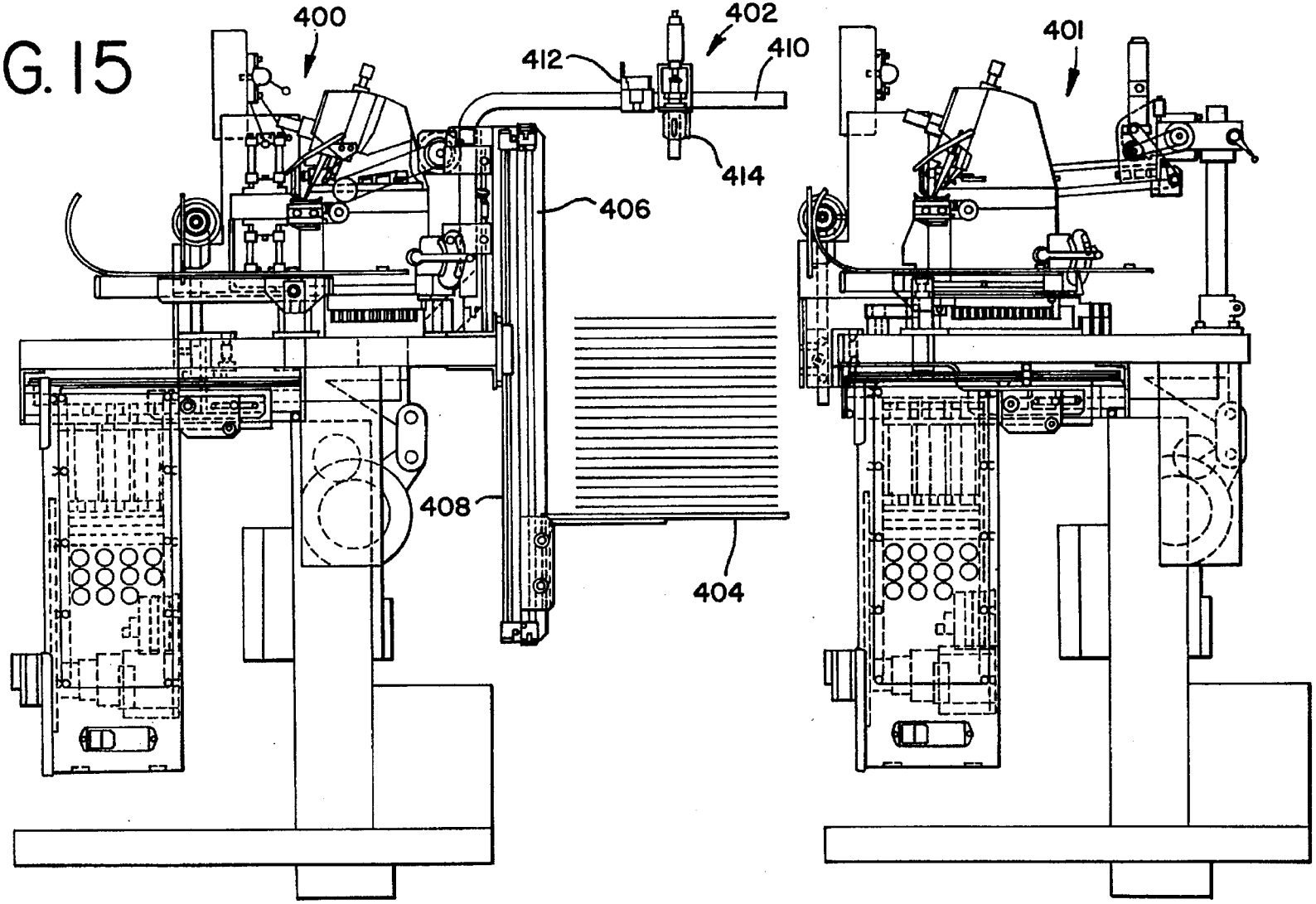
FIG. 15 is a front view of the work station including two sleeve setting machines and including the sleeve pickup device.

A sleeve pickup device 402, see FIG. 15, is located between machines 400 and 401. The sleeve pickup device 402 includes a sleeve picker tray 404 upon which there is a stack of shirt sleeves 200. The sleeve picker tray 404 is mounted on a vertical support 406 that is secured to the table board of machine 400. The sleeve picker tray 404 moves vertical relative to the vertical support 406 in response to actuation of an air cylinder 408. The microprocessor control 50 outputs Sleeve Tray Up and Sleeve Tray Down signals to cause the sleeve picker tray 404 to move in the appropriate direction at the proper time. A horizontal arm 410, is supported by the vertical support 406, and is cantilevered over the sleeve picker tray 404. A sleeve release sensor 412 is carried by the horizontal arm 410. When the sleeve release sensor 412 is interrupted by the operator's hand grasping a sleeve a Sleeve Release Sensor input signal is sent to the Microprocessor control 50 and the cycle to grip and open another sleeve is started.

Figure 16:
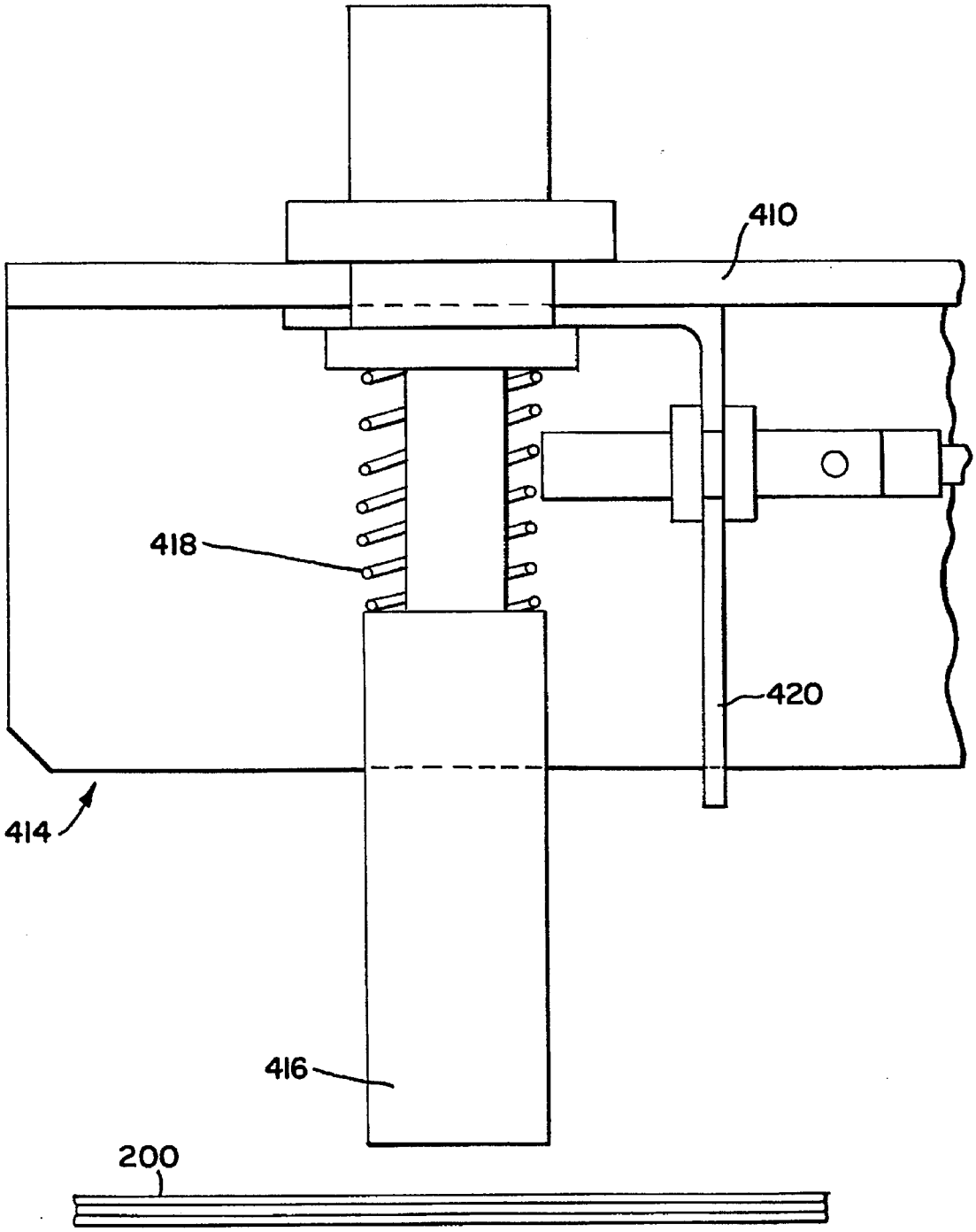
FIG. 16 is an enlarged view of the sleeve gripper and sensor devices.

A sleeve gripper 414 is also supported on horizontal arm 410. Reference will now be made to FIG. 16 which is an enlarged view of the sleeve gripper 414. The pickup finger 416 is mounted for limited vertical movement and is forced down by a spring 418. A gripper sensor 420 is supported adjacent the pickup finger 416. The pickup finger 416 is forced up when it is engaged by the rising sleeves 200 on the sleeve tray 404 until the gripper sensor 420 is tripped. When the gripper sensor 420 is tripped a Gripper Sensor input signal is sent to the microprocessor control 50 which causes a Gripper output signal to be sent from the microprocessor control 50. The Gripper output signal causes pressurized air to be sent to the sleeve gripper 414, which actuates the pickup fingers 416 to open. The pressurized air is then released and the pickup fingers close to grasp the top ply of the top sleeve from the stack. The sleeve tray 404 is then lowered and the top sleeve 200 from the stack is retained by the pickup fingers 416 such that the operator can effortlessly reach in and grasp a single sleeve 200. Since the sleeve is tubular shaped and the pickup fingers 416 have grasp only the top ply, as the sleeve tray is lowered the sleeve opens up. Thus, the sleeve gripper 414 separates one sleeve from a stack of sleeves making it very easy for the operator to grab the sleeve quickly. The sleeve gripper also opens the sleeve so that the operator does not waste time and effort trying to separate the plies of the sleeve. For a more complete disclosure of the operation of the sleeve gripper 414, reference should be had to U.S. Pat. No. 5,190,275 which Patent is hereby by reference made a part of this disclosure.

The operator then places the sleeve on the rollers 72, 80 of one of the machines, for this discussion machine 401 which shall in this discussion be referred to as machine one. As previously stated during the loading operation of the rollers 72, 80 the table 150 has been lowered to facilitate the loading operation. As the operator places the sleeve on the rollers 72, 80 the sleeve sensor 100 is covered which initiates several machine motions and the movement of the loader tray 430.

Figure 17:
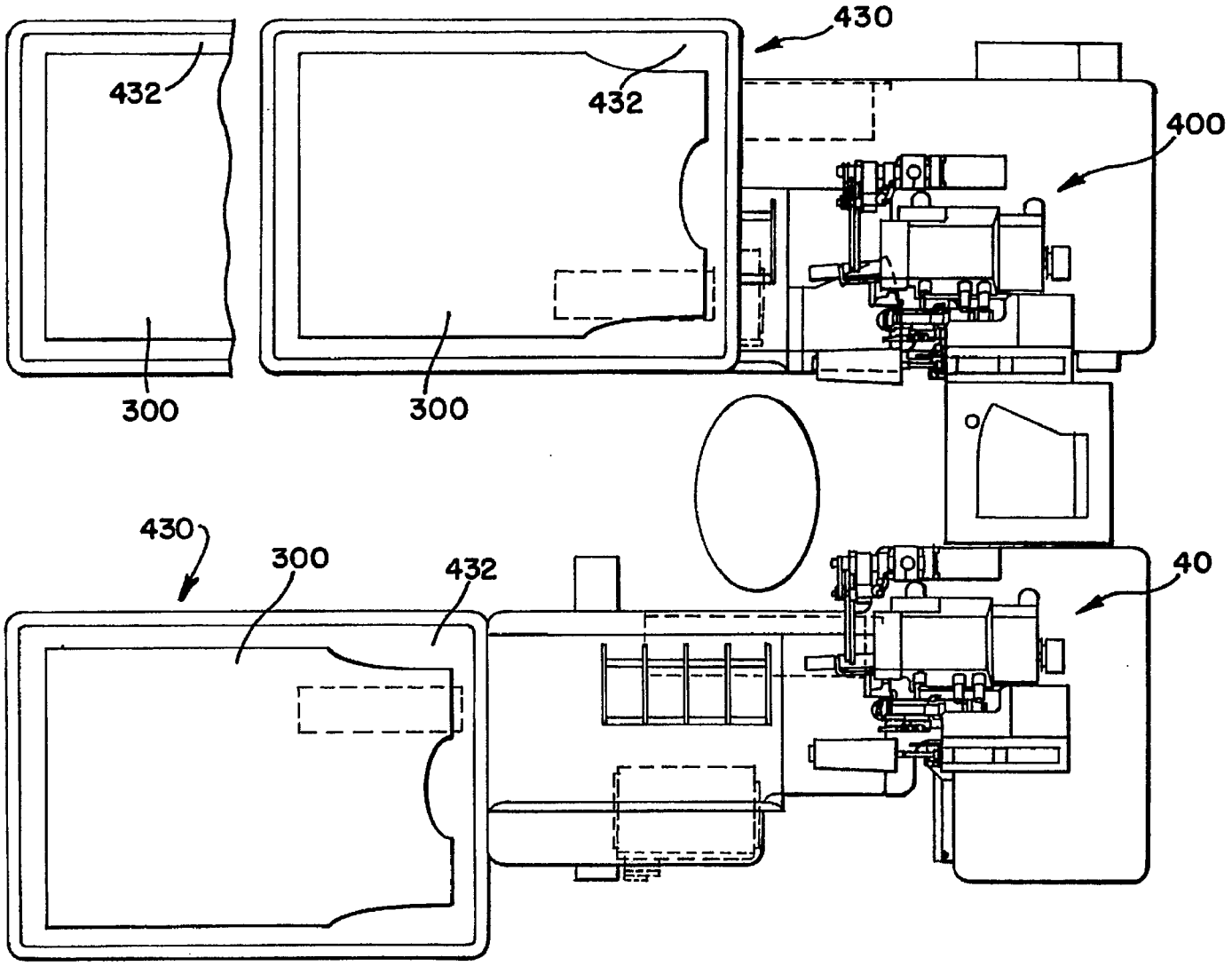
FIG. 17 is a plan view of the work station including two sleeve setting machines and including the sleeve pickup device and the loader trays with one loader tray located at the sew area and a portion of that tray shown at its location away from the sew area.

The loader trays 430 are mounted on the frames 40 for movement toward and away from the sewing machine 400 and 401. Each loader tray 430 has a top tray 432 and a bottom tray 434. The top tray 432 carries a stack of shirt bodies and the finished shirts are deposited on the bottom tray 434. As best illustrated in FIG. 17, the top tray 432 for machine 400 is shown at its location adjacent the sew area in B its entirety and partially at its location remote from the sew area. The movement of the loader tray 430 is controlled by a signal from the microprocessor control 50.

In response to the sleeve sensor 100 being activated by the operator the top tray 432 moves toward the sewing area and the operator grasp a shirt body 300 from the top tray 432. The top tray 432 brings the shirt bodies 300 toward the sewing area so the operator does not have to reach for them. The operator loads one arm hole of the shirt body 300 over the rollers 72, 80 that already have the sleeve 200 loaded thereon. The top tray 432 then retracts. The shirt body sensor 101 is covered as the shirt body is loaded which initiates several body load motions and a count down begins for a delay period. When this delay period expires the sew cycle for the machine one (machine 401) begins.

The operator then grasps another sleeve 200 from the sleeve gripper 414 and loads it on the rolls 72, 80 of machine two (machine 400). Loading this sleeve 200 on machine two has the same results as loading the above discussed sleeve on machine one. The sleeve sensor 100 is covered which initiates several machine motions and the movement of the loader tray 430. The operator then grabs a shirt body 300 from the top tray 432 and loads it over the sleeve 200 that is carried by the rolls 72, 80 of machine two (machine 400).

As machine one (machine 401) nears the end of its saw cycle the top tray 432 moves toward the sew area to a location at which it overlays the table 150. When the sew cycle for machine one (machine 401) is completed, the shirt continues to be rotated for 180 degrees by the side feed puller 82. The air blowers 152 also contribute to this rotation of the shirt. This 180 degree rotation orients the shirt body with the collar on top and saves the operator the time and effort of finding the armhole opening for the second sleeve.

After the 180 degree rotation is completed an arm 436, that is pivotally connected to the bottom surface of the top tray 432, drops onto the shirt body, to capture the shirt body between the arm 436 and the table 150. The top tray 432 then retracts, dragging the shirt body 300 with one sleeve 200 attached with it. The shirt body 300 with one sleeve 200 attached is pulled to a position at which it has been removed from the rollers 72, 80. This automatic unloading of the shirt body 300 with one sleeve 200 attached relieves the operator of this task and speeds the overall operation. The shirt body 300 with one sleeve 200 attached is now ready to have a second sleeve 200 attached.

The operator grabs a sleeve 200 from the sleeve gripper 414 and loads it on the rollers 72, 80 of machine one (machine 401). When the sleeve 200 is grabbed by the operator the sleeve release sensor 412 is actuated which starts the cycle to grip and open another sleeve. When the operator loads the sleeve on the rollers the sleeve sensor 100 is covered and a Sleeve Load input signal is sent to the microprocessor control 50. However, unlike when the first sleeve for machine one was grasped a shirt body 300 is not needed from the top tray 432 since this sleeve will be sewn to the shirt body 300 with one sleeve 200 attached. The shirt body 300 with one sleeve 200 attached is in the sew area where it is convenient for the operator to grasp. Thus a Top Tray Output signal to causes the top tray 432 to move toward the sew area is not sent. The operator grasps the shirt body 300 with one sleeve 200 attached from the table 150, locates the second arm hole and loads it on rollers 72, 80 over the sleeve.

Meanwhile, machine two (machine 400) has completed the sew cycle for attaching the first sleeve 200 to the shirt body 300 and the work product has been pulled off the rolls 72, 80 by the arm 436 that is carried by the lower surface of top tray 432. The operator then grasp a sleeve 200 that is held by the sleeve gripper 414 and loads it on the rollers 72, 80 of machine two (machine 400). When the sleeve 200 is grabbed by the operator the sleeve release sensor 412 is actuated which starts the cycle to grip and open another sleeve. When the operator loads the sleeve on the rollers the sleeve sensor 100 sensor is covered, a Sleeve Load Input signal is sent to the microprocessor control 50. However unlike when the first sleeve for machine two was grasped a shirt body 300 is not needed from the top tray 432 since the shirt body 300 with one sleeve 200 attached will be utilized. Shirt body 300 with one sleeve 200 attached is in the sew area where it is convenient for the operator to grasp. Thus a Top Tray Output signal to cause the top tray 432 to move toward the sew area is not sent. The operator grasps the shirt body 300 with one sleeve 200 attached from the table 150, locates the second arm hole and loads it on rollers 72, 80 over the sleeve.

Meanwhile, machine one (machine 401) has completed the sew cycle for the second sleeve 200 and the top tray 432 has moved in, arm 436 has dropped and drug the finished shirt back to a position off the rollers 72, 80. The table 150 has been lowered to facilitate loading of the rollers 72, 80.

Figure 18:
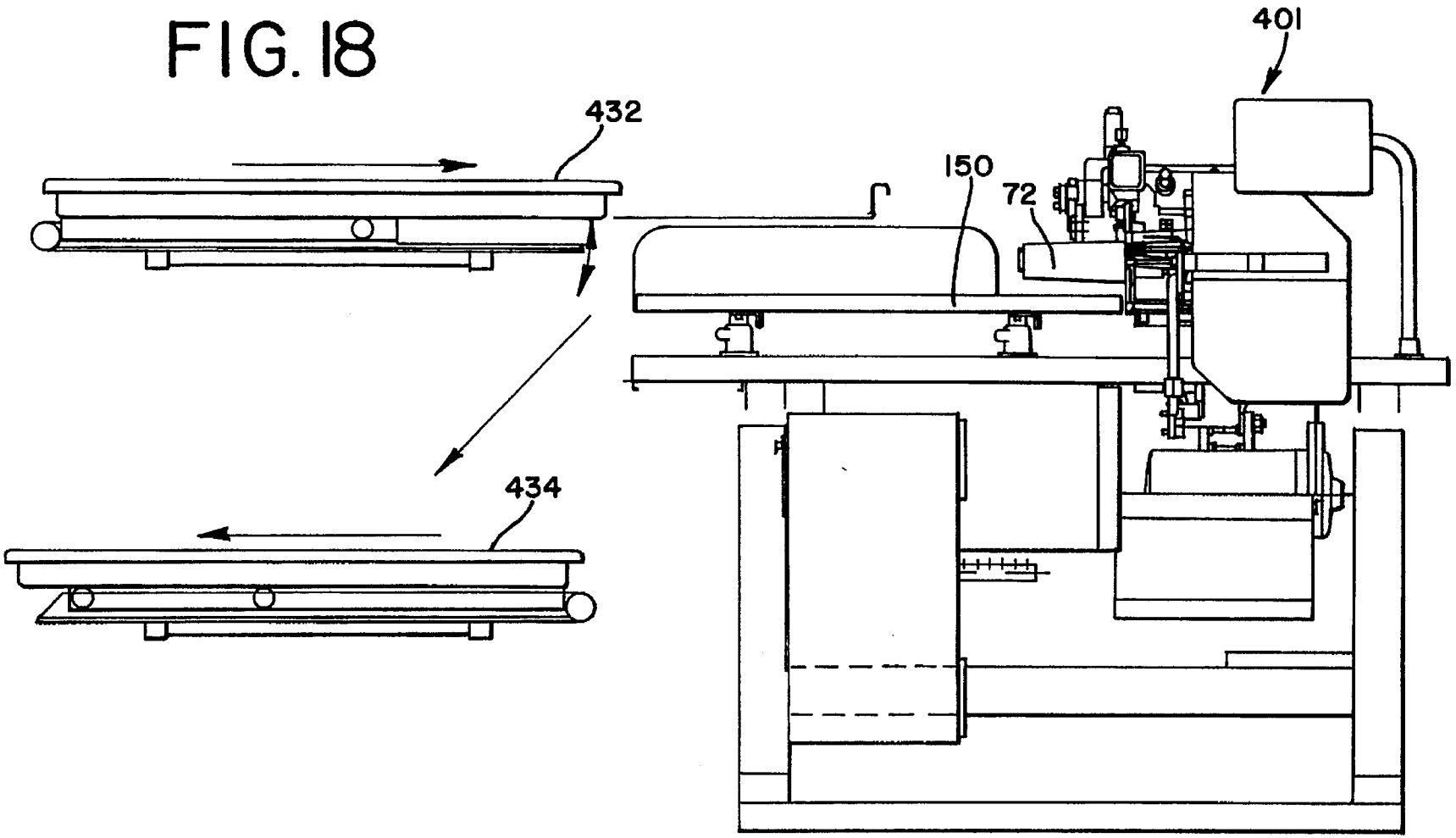
FIG. 18 is side view of the work station in which one of the sleeve setting machines is positioned as well as the top and bottom trays.

The operator grabs another sleeve 200 from the sleeve gripper 414 and loads it on the rolls 72, 80 of machine one (machine 401). This sleeve is the first sleeve for the third shirt to be produced in this discussion. When the sleeve 200 is grabbed by the operator the sleeve release sensor 412 is actuated which starts the cycle to grip and open another sleeve. The operator loads the sleeve on the rollers 72, 80 of machine one (401) which causes the sleeve sensor 100 sensor to be covered. A Sleeve Load Input signal is sent to the microprocessor control 50 which causes the top tray 432 to be moved in to the sew area and the operator grabs a shirt body 300 from the top tray 432 and loads it on rollers 72, 80 of machine one (401). As best seen in FIG. 18, when the top tray 432 is about to retract the arm 436 drops down and captures the finished shirt between arm 436 and table 150 and as top tray 432 retracts the finished shirt is drug off table 150 and deposited on the bottom tray 434. Thus, the finished garments are removed from the sew area without any effort on the part of the operator.

At this point the first finished garment of machine two (machine 400) has been completed and has been pulled off the rollers 72, 80. The table 150 has been lowered. The operator grasps another sleeve 200 from the sleeve gripper 414 and the series of cycles has begun to produce a second finished product on machine two (machine 400). The first finished product, from machine two (machine 400) is automatically removed from the table by the arm 436 and deposited on the lower tray 438. The cycle for setting sleeves in shirt bodies continues in an efficient and non-strenuous fashion for the operator.

Figure 19:
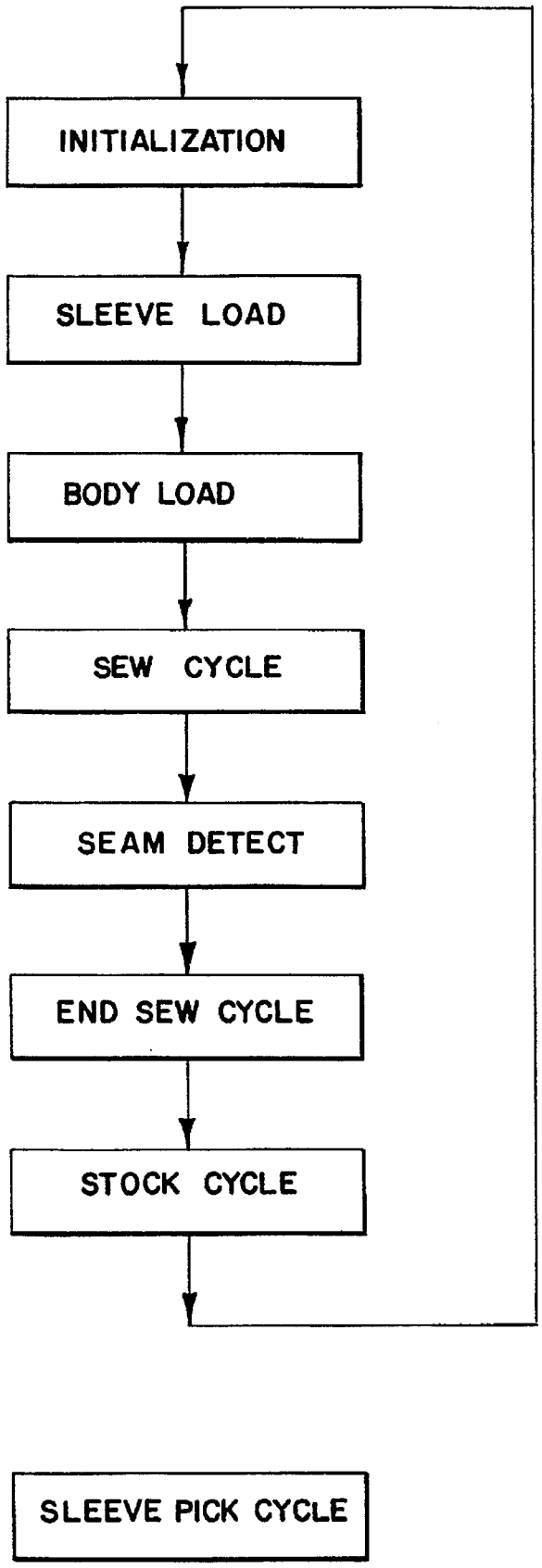
FIG. 19 is a block diagram of the set sleeve timing structure.

The stages of the set sleeve operation are indicated in the block diagram of FIG. 19. Prior to initiating the automatic sewing cycle the operator selects "Automatic Mode" from the control panel of the microprocessor. The upper sequence of stages, as seen in FIG. 19, begins with Initialization of the machines which includes locating the feed roller 72, edge guider assembly, the top 432 and bottom 434 trays and the unloader arm 436 such that they are ready to receive the work products. The side feed puller 82 is raised and front tensioning roller 72 is retracted to its load position.

The Sleeve Pick Cycle is independent of the sequence of cycles illustrated in the upper portion of FIG. 19. When a sleeve is grasped and removed from the holder the sleeve pick up mechanism automatically recycles and presents another sleeve to the operator in a manner that is convenient for the operator to grasp.

After Initialization the Sleeve Load stage occurs and when it is finished the Body Load stage begins. After the sleeve body has been loaded the Sew Cycle is began and it continues until the Seam Detect cycle begins which interrupts the Sew Cycle. The Sew cycle is then completed by the End Sew Cycle after which the Stack cycle follows. When the Stack cycle is completed the sequence begins again with the Initialization step.

The timing of the steps within each stage will depend upon the particular type of garment that is being produced, the skill of the operator as well as the various sensors embodied in the overall machine.

Figure 20:
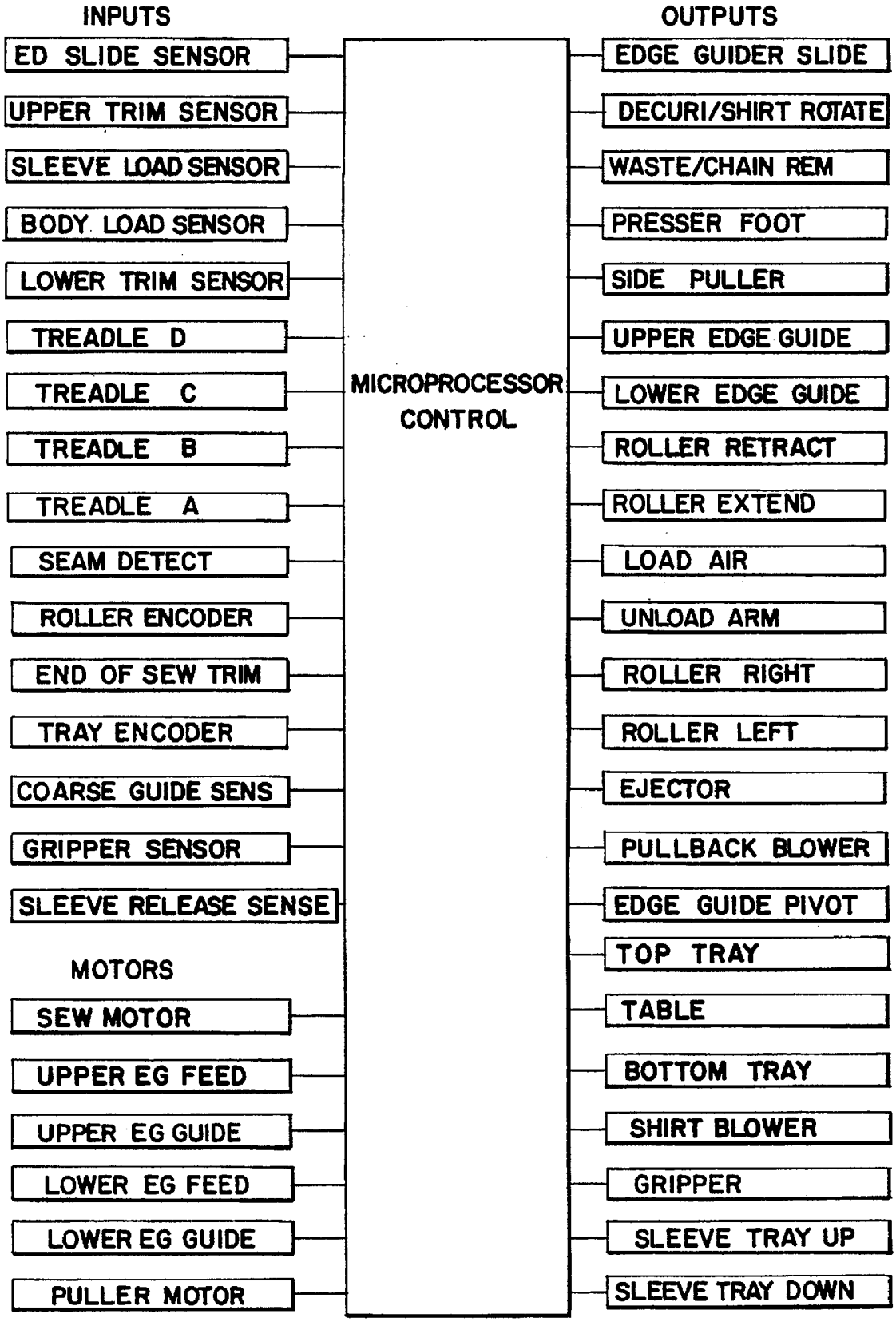
FIG. 20 is a block diagram of the system's microprocessor control including its inputs and output.

FIG. 20 is a block diagram that includes the systems microprocessor control 50, the components that it controls including the stepper motors and the components from which the control 50 receives and sends signals.

While the invention has heretofore been described in detail with particular reference to the illustrated apparatus, it is to be understood that variations, modifications and the use of equivalent mechanisms can be effected without departing from the scope of this invention. It is, therefore, intended that such changes and modifications be covered by the following claims.

What is claimed is:

1. A sewing apparatus having a work station for an operator who is sewing sleeves on shirt bodies using two sewing machines having automatic sew cycles, comprising:

a first and a second machine having automatic sew cycles, each sewing machine including material handling mechanisms, said sewing machines located relative to each other such that their directions of loading are substantially opposite, and there is an operator station therebetween;

an operating system that receives and sends signals to accommodate said automatic sew cycle;

a sleeve tray for supporting a stack of sleeves, a sleeve picker associated with said sleeve tray, said sleeve picker adapted to pick up the top sleeve on the stack and present it for easy grasp by the operator;

a sleeve release sensor located such that it will be actuated when the operator grasps a sleeve held by said sleeve picker and will, when actuated, send a signal to said operating system that causes said operating system to send a signal to said sleeve picker which causes said sleeve picker to release the sleeve presented for easy grasp and initiate its cycle to pick up the next sleeve on the stack;

a first loader tray for supporting a stack of shirt bodies that are to be sewn by said first sewing machine, said first loader tray mounted for movement toward and away from said operator station;

a first sleeve sensor located such that it will be actuated when the operator places a sleeve on the material handling mechanism of said first machine and will, when actuated, send a signal to said operating system that will cause said first loader tray to move toward and then retract from the operator station;

a first shirt body sensor located such that it will be actuated when the operator places a shirt body on the material handling mechanism of said first machine and will, when actuated, send a signal to said operating system that will in response thereto initiate a delay period and after the expiration of said delay period start the automatic sew cycle for said first sewing machine;

a second loader tray for supporting a stack of shirt bodies that are to be sewn by said second sewing machine, said second loader tray mounted for movement toward and away from said operator station;

a second sleeve sensor located such that it will be actuated when the operator places a sleeve on the material handling mechanism of said second machine and will, when actuated, send a signal to said operating system that will cause said second loader tray to move toward and them retract from the operator station;

a second shirt body sensor located such that it will be actuated when the operator places a shirt body on the material handling mechanism of said second machine and will, when actuated, send a signal to said operating system that will in response thereto initiate a delay period and after the expiration of said delay period start the automatic sew cycle for said second sewing machine.

2. The invention as set forth in claim 1 wherein:

said first and second sewing machines each include a shirt table that underlies said material handling mechanisms;

said automatic sew cycle for said first sewing machine causes said first load tray to move toward said work station as said first sewing machine approaches the end of its sew cycle;

a first unloader arm carried by said first loader tray, said first unloader arm drops onto the first shirt body and secures the first shirt body between said first unloader arm and the shirt table of said first sewing machine;

mechanisms for moving said first load tray away from said work station causing said first shirt body with one attached sleeve to be removed from the material handling mechanism;

said automatic sew cycle for said second sewing machine causes said second load tray to move toward said work station as said second sewing machine approaches the end of its sew cycle;

a second unloader arm carried by said second loader tray, said second unloader arm drops onto the second shirt body and secures the second shirt body between said second unloader arm and the shirt table of said second sewing machine; and mechanisms for moving said second load tray away from said work station causing said second shirt body with one attached sleeve to be removed from the material handling mechanism.

3. The invention as set forth in claim 2 wherein the material handling mechanisms for each sewing machine includes:

a side feed puller that functions to pull the sleeve and shirt body along the direction of feed during the sew cycle, said side feed puller also functioning after the shirt body with one sleeve attached has been pulled off the material handling mechanisms to rotate the shirt body with one attached sleeve to the position for attaching the second sleeves.

4. A method for sewing sleeves on shirt bodies using two sewing machines having automatic sew cycles, comprising the steps of:

(1). locating a first and a second sewing machine having material handling mechanisms, relative to each other such that their directions of loading are substantially opposite and there is an operator work station between the machines;

(2). presenting a first sleeve at the operator work station for easy grasp by an operator;

(3). sensing the operator grasping the sleeve;

(4). releasing the sleeve to the operator in response to sensing the operator grasping the sleeve;

(5). initiating a cycle to acquire another sleeve to be presented at the operator station for easy grasp by an operator;

(6). sensing when the operator loads a first sleeve on the material handling mechanism of the first sewing machine;

(7). moving a first loader tray carrying shirt bodies to the work station where the shirt bodies can be easily grasped by the operator;

(8). grasping a shirt body and loading it on the material handling mechanism of said first machine;

(9). initiating the automatic sew cycle for the first sewing machine;

(10). presenting a second sleeve at the operator station for easy grasp by an operator;

(11). sensing the operator grasping the second sleeve;

(12). releasing the second sleeve to the operator in response to sensing the operator grasping the sleeve;

(13). initiating a cycle to acquire another sleeve to be presented at the operator station for easy grasp by an operator;

(14). sensing when the operator loads the second sleeve on the material handling mechanism of the second sewing machine;

(15). moving a second loader tray carrying shirt bodies to the work station where the shirt bodies can be easily grasped by the operator:

(16). grasping a second shirt body and loading it on the material handling mechanism of said second sewing machine;

(17). sensing the second shirt body being loaded on the second sewing machine;

(18). initiating the automatic sew cycle for the second sewing machine;

(19). completing the automatic sew cycle for said first sewing machine;

(20). moving the first load tray toward the work station to a position overlaying said first shirt body;

(21). attaching the first shirt body and attached first sleeve to said first loader tray;

(22). moving said first load tray in a direction away from said work station and sliding the attached first shirt body and sleeve off said material handling mechanism of said first sewing machine;

(23). presenting a third sleeve at the operator station for easy grasp by an operator;

(24). sensing the operator grasping the third sleeve;

(25). releasing the third sleeve to the operator in response to sensing the operator grasping the sleeve;

(26). initiating a cycle to acquire another sleeve to be presented at the operator station for easy grasp by an operator;

(27). sensing when the operator loads the third sleeve on the material handling mechanism of the first sewing machine;

(28). grasping the first shirt body and attached sleeve:

(29). loading the first shirt body and attached sleeve on the material handling mechanism of said first machine for attachment of the other sleeve;

(30). initiating the automatic sew cycle for the first sewing machine;

(31). completing the automatic sew cycle for said second sewing machine;

(32). moving the second load tray toward the work station to a position overlaying said second shirt body;

(33). attaching the second shirt body and attached first sleeve to said second loader tray;

(34). moving said second load tray in a direction away from said work station and sliding the attached second shirt body and attached first sleeve off said material handling mechanism of said second sewing machine;

(35). presenting a fourth sleeve at the operator station for easy grasp by an operator;

(36). sensing the operator grasping the fourth sleeve;

(37). releasing the fourth sleeve to the operator in response to sensing the operator grasping the sleeve;

(38). initiating a cycle to acquire another sleeve to be presented at the operator station for easy grasp by an operator;

(39). loading the fourth sleeve on the material handling mechanism of the second sewing machine;

(40). sensing when the operator loads the fourth sleeve on the material handling mechanism of the first sewing machine;

(41). grasping the second shirt body and attached sleeve;

(42). loading the second shirt body and attached sleeve on the material handling mechanism of said second sewing machine for attachment of the other sleeve;

(43). initiating the automatic sew cycle for the second sewing machine.

5. The method as recited in claim 4 wherein after steps (19) and (31) the following step is performed:

(44). rotating the shirt body and attached sleeve 180° to a position that will facilitate loading the shirt body and attached sleeve on the material handling mechanism for attachment of the other sleeve.

6. A sewing machine in combination with a work piece control and advancing mechanism and a microprocessor for setting sleeves into a shirt body in which a sew cycle of a sleeve setting procedure is performed automatically;

said sewing machine including stitch forming instruments for forming a seam having a stitch line a predetermined distance from aligned circular edges of a shirt body arm hole and a sleeve arm hole;

a frame, said sewing machine and said work piece control and advancing mechanism mounted on said frame;

said work piece control and advancing mechanism including edge guider mechanisms that function to individually control the circular edges of the shirt body arm hole and the sleeve arm hole such that their marginal edges are maintained aligned at a predetermined distance from said stitch line as the circular edges of the work pieces advances toward said stitch forming instruments;

said work piece control and advancing mechanism including a seam detector mechanism that detects the beginning of the seam as it returns to said edge guider mechanisms and sends a seam detect signal to said microprocessor;

said microprocessor, in response to said seam detect signal, causes said edge guider mechanisms to be withdrawn from the sew area;

said microprocessor, in response to said seam detect signal, actuating components of the sewing machine and work piece control and advancing mechanism at predetermined times measured from the seam detect signal to automatically complete the sew cycle and eject the sewn garment from the stitch forming instruments;

said work piece control and advancing mechanism includes a set of rollers for supporting the work pieces during the loading and sewing cycles, one roll of said set being located forward of and the other being located rearward of said stitch forming instruments;

said roll that is located forward of said stitch forming instruments being conically shaped and oriented such that it is smaller at its free end than at its other end.

7. The invention as set forth in claim 6 wherein said conically shaped roll has a spiral groove formed along its surface that, when the roll is rotated, exerts a force on the sleeve tending to move the sleeve from the small end of the conically shaped roll to its other end.

8. A sewing machine in combination with a work piece control and advancing mechanism and a microprocessor for setting sleeves into a shirt body in which a sew cycle of a sleeve setting procedure is performed automatically;

said sewing machine including stitch forming instruments for forming a seam having a stitch line a predetermined distance from aligned circular edges of a shirt body arm hole and a sleeve arm hole;

a frame, said sewing machine and said work piece control and advancing mechanism mounted on said frame;

said work piece control and advancing mechanism including edge guider mechanisms that function to individually control the circular edges of the shirt body arm hole and the sleeve arm hole such that their marginal edges are maintained aligned at a predetermined distance from said stitch line as the circular edges of the work pieces advances toward said stitch forming instruments;

said work piece control and advancing mechanism including a seam detector mechanism that detects the beginning of the seam as it returns to said edge guider mechanisms and sends a seam detect signal to said microprocessor;

said microprocessor, in response to said seam detect signal, causes said edge guider mechanisms to be withdrawn from the sew area;

said microprocessor, in response to said seam detect signal, actuating components of the sewing machine and work piece control and advancing mechanism at predetermined times measured from the seam detect signal to automatically complete the sew cycle and eject the sewn garment from the stitch forming instruments;

said work piece control and advancing mechanism includes a set of rollers for supporting the work pieces during the loading and sewing cycles, one roll of said set, the front tensioning roller, being located forward of said stitch forming instruments and the other roller be located rearward of the stitch forming instruments;

said work piece control and advancing mechanism including an anti-roll bar that is located adjacent said front tensioning roller such that it will engage and press the work product against the front tensioning roller to prevent the work product from rolling over.

9. The invention as set forth in claim 8 wherein said anti-roll bar is movably mounted on said work piece control and advancing mechanism such that it can be retracted away from said front tensioning roller prior to loading said sleeve and shirt body on said set of rollers.

10. A sewing machine in combination with a work piece control and advancing mechanism and a microprocessor for setting sleeves into a shirt body in which a sew cycle of a sleeve setting procedure is performed automatically;

said sewing machine including stitch forming instruments for forming a seam having a stitch line a predetermined distance from the aligned circular edges of a shirt body arm hole and a sleeve arm hole;

a frame, said sewing machine and said work piece control and advancing mechanism mounted on said frame;

a work piece support table mounted on said frame such that said table is movable relative to said work piece control and advancing mechanism to a position that facilitates loading a work product on said work piece control and advancing mechanism;

said work piece control and advancing mechanism including edge guider mechanisms that function to individually control circular edges of the shirt body arm hole and the sleeve arm hole such that their marginal edges are maintained aligned at a predetermined distance from said stitch line as the circular edges of the work pieces advances toward said stitch forming instruments;

said work piece control and advancing mechanism including a seam detector mechanism that detects the beginning of the seam as it returns to said edge guider mechanisms and sends a seam detect signal to said microprocessor;

said microprocessor, in response to said seam detect signal, causes said edge guider mechanisms to be withdrawn from the sew area;

said microprocessor, in response to said seam detect signal, actuating components of the sewing machine and work piece control and advancing mechanism at predetermined times measured from the seam detect signal to automatically complete the sew cycle and eject the sewn garment from the stitch forming instruments.

11. A sewing machine in combination with a work piece control and advancing mechanism and a microprocessor for setting sleeves into a shirt body in which the sew cycle of the sleeve setting procedure is performed automatically;

said sewing machine including stitch forming instruments for forming a seam having a stitch line a predetermined distance from the aligned circular edges of a shirt body arm hole and a sleeve arm hole;

a frame, said sewing machine and said work piece control and advancing mechanism mounted on said frame;

said work piece control and advancing mechanism including edge guider mechanisms that function to individually control circular edges of the shirt body arm hole and the sleeve arm hole such that their marginal edges are maintained aligned at a predetermined distance from said stitch line as the circular edges of the work pieces advances toward said stitch forming instruments;

said work piece control and advancing mechanism including a seam detector mechanism that detects the beginning of the seam as it returns to said edge guider mechanisms and sends a seam detect signal to said microprocessor;

said microprocessor, in response to said seam detect signal, causes said edge guider mechanisms to be withdrawn from the sew area;

said microprocessor, in response to said seam detect signal, actuating components of the sewing machine and work piece control and advancing mechanism at predetermined times measured from the seam detect signal to automatically complete the sew cycle and eject the sewn garment from the stitch forming instruments;

said edge guider mechanisms including a sensor that monitors the sewn edge after the beginning of the seam has been detected, said edge guider mechanisms being controlled by said sensor that monitors the sewn edge after the beginning of the seam has been detected to complete the sew cycle.

12. A sewing machine in combination with a work piece control and advancing mechanism and a microprocessor for setting sleeves into a shirt body in which the sew cycle of the sleeve setting procedure is performed automatically;

said sewing machine including stitch forming instruments for forming a seam having a stitch line a predetermined distance from the aligned circular edges of a shirt body arm hole and a sleeve arm hole;

a frame, said sewing machine and said work piece control and advancing mechanism mounted on said frame;

said work piece control and advancing mechanism including edge guider mechanisms that function to individually control circular edges of the shirt body arm hole and the sleeve arm hole such that their marginal edges are maintained aligned at a predetermined distance from said stitch line as the circular edges of the work pieces advances toward said stitch forming instruments, said edge guider mechanisms including gripper wheels that engage the work product;

said work piece control and advancing mechanism including a seam detector mechanism that detects the beginning of the seam as it returns to said edge guider mechanisms and sends a seam detect signal to said microprocessor;

said microprocessor, in response to said seam detect signal, causes said edge guider mechanisms to be withdrawn from the sew area;

said microprocessor, in response to said seam detect signal, actuating components of the sewing machine and work piece control and advancing mechanism at predetermined times measured from the seam detect signal to automatically complete the sew cycle and eject the sewn garment from the stitch forming instruments;

a knockdown wire mounted on an edge guider mechanism, said knockdown wire being formed from spring wire that has been formed to include a work product engaging free end portion that engages the upper surface of the work product before it is engaged by a gripper wheel.

* * * * *